US009144253B1

(12) United States Patent
Munter et al.

(10) Patent No.: US 9,144,253 B1
(45) Date of Patent: Sep. 29, 2015

(54) SYSTEM FOR INTEGRATING A KNEE PAD INTO A GARMENT

(75) Inventors: Michael E. Munter, Ashland, OR (US); Lindsay M. Evans, Talent, OR (US); Martin L. Flora, Ashland, OR (US); Carl R. Taylor, Jr., Ashland, OR (US); Brett D. Ritter, Santa Barbara, CA (US)

(73) Assignee: Samtech, LLC, Los Angeles, CA (US)

( * ) Notice: Subject to any disclaimer, the term of this patent is extended or adjusted under 35 U.S.C. 154(b) by 13 days.

(21) Appl. No.: 13/325,844

(22) Filed: Dec. 14, 2011

Related U.S. Application Data

(60) Provisional application No. 61/422,820, filed on Dec. 14, 2010.

(51) Int. Cl.
*A41D 13/06* (2006.01)

(52) U.S. Cl.
CPC ..... *A41D 13/065* (2013.01)

(58) Field of Classification Search
CPC ..... A41D 1/06; A41D 1/08; A41D 13/0002; A41D 13/0005; A41D 13/0012; A41D 13/015; A41D 13/055; A41D 13/0556; A41D 13/0568; A41D 13/0581; A41D 13/0587; A41D 13/06; A41D 13/065; A41D 13/0543; A41D 13/05; A63B 71/1225
USPC ..... 2/22, 23, 24, 267, 231, 241
See application file for complete search history.

(56) References Cited

U.S. PATENT DOCUMENTS

| | | | | |
|---|---|---|---|---|
| 891,533 | A * | 6/1908 | Gibbs | 2/24 |
| 5,309,570 | A * | 5/1994 | Grimm | 2/24 |
| 5,611,081 | A | 3/1997 | Torres | |
| 5,628,063 | A | 5/1997 | Reed | |
| 6,347,403 | B1 * | 2/2002 | Wilcox | 2/23 |
| 6,704,938 | B2 * | 3/2004 | Crockett | 2/23 |
| 6,988,281 | B1 * | 1/2006 | Jerome et al. | 2/24 |
| 7,380,283 | B1 | 6/2008 | Dumont | |
| 7,415,733 | B2 * | 8/2008 | Rampersad | 2/23 |
| 7,490,360 | B2 * | 2/2009 | Meadows | 2/23 |
| D648,922 | S * | 11/2011 | Evans et al. | D2/742 |
| 2007/0050877 | A1 | 3/2007 | Rampersad | |
| 2007/0150993 | A1 | 7/2007 | Oh et al. | |
| 2008/0115248 | A1 | 5/2008 | Meadows | |
| 2008/0289072 | A1 * | 11/2008 | Shin | 2/23 |
| 2010/0223709 | A1 * | 9/2010 | Crye | 2/16 |
| 2010/0235960 | A1 * | 9/2010 | Johnson | 2/23 |
| 2013/0061365 | A1 * | 3/2013 | Arceo | 2/24 |

* cited by examiner

*Primary Examiner* — Andrew W Collins
(74) *Attorney, Agent, or Firm* — Dority & Manning, P.A.

(57) ABSTRACT

Various embodiments of garments for use in conjunction with knee pads are disclosed. In one embodiment, the knee pads can be integrated into the garment. The garment can include leg gathering devices for positioning the knee pads over the knees of the wearer when the knee pads are needed. Releasing the leg gathering devices, on the other hand, allows the pants to drape normally. In an alternative embodiment, a knee pad can be provided that can be releasably attached to a garment. In this embodiment, the garment can include a plurality of engaging devices for attachment to the knee pad. The engaging devices can be positioned at different heights for allowing vertical adjustability.

22 Claims, 21 Drawing Sheets

SYSTEM FOR INTEGRATING A KNEE PAD INTO A GARMENT

RELATED APPLICATIONS

The present application claims priority to and is based upon U.S. Provisional Patent Application Ser. No. 61/422,820, filed on Dec. 14, 2010 and incorporated herein by reference.

BACKGROUND

Knee pads are commonly worn by those engaged in certain occupations or sporting activities. Knee pads are designed to cover the patella of a wearer in order to protect the knee against impact Injury should the wearer fall on his or her knee. Knee pads are also used to provide padding, comfort and also protect against injury for individuals who are subjected to extended kneeling.

For example, military personnel in the armed services are using knee pads more frequently in order to protect their knees during field operations. The knee pads, for instance, allow the wearer to drop more readily into a firing position and/or into a position of cover.

Knee pads worn by military personnel should be designed to protect the knee while also providing the wearer with a full range of motion. The knee pads should also be comfortable, especially if worn for prolonged periods of time. Ideally, knee pads, especially those worn by the military, should fulfill various requirements related to the properties of fit, comfort and functionality.

For example, knee pads integrated with pants and other legwear should fit appropriately over the knee when being worn. Problems, however, persist in that many knee pad systems are not adequately adjustable when the height or other proportions of the wearer change. For instance, many knee pad systems only provide proper fit for individuals within a particular height and weight range. For individuals outside the range, the knee pad may not properly fit over the person's knee when worn.

In addition to fit, knee pads should also fulfill the functional requirements that correspond with the occupation of the wearer. For instance, knee pads should provide sufficient shock attenuation for a given design. Further, the attachment mechanism of the knee pad should not only be simple to use, but should also be capable of withstanding forces that are generated during normal use of the knee pad. The attachment system should also ensure that the knee pad stays in place without having to be constantly readjusted. In addition, the knee pad should provide a stable platform for the wearer and should not create issues with respect to rocking.

Knee pads should also be comfortable to wear. For example, many knee pads are designed to fit properly but are simply not comfortable to wear especially over prolonged periods of time. For example, many knee pads include straps that completely encircle the leg of the wearer. Such straps not only tend to rub on the leg of the wearer, but also tend to restrict blood flow.

Other comfort issues can also arise if the knee pad does not provide sufficient cushioning effect. Further, many knee pads have a tendency to trap body heat and thus become very uncomfortable to wear, especially in warm to hot environments. Once body heat is trapped, for instance, the wearer tends to sweat which then creates greater problems associated with the knee pad rubbing against the skin or clothes.

In many applications, especially in military applications, knee pads must also be capable of having a cooperative relationship with the pants worn by the wearer. For example, in many applications, it is desirable to loosen the knee pads when not kneeling. Many knee pad systems, however, are not only uncomfortable when the wearer is not kneeling but also have a tendency to interfere with the pants of the wearer, causing the pants to bunch and gather in an irregular manner during standing, walking or other actions.

In view of the above, a need currently exists for an improved knee pad that provides improved fit, functionality and/or comfort. In particular, a need exists for a knee pad system that can be integrated with the pants of a wearer while having proper fit, functionality and comfort. A need particularly exists for a knee pad system that actively engages the pants of a wearer to place a knee pad in the proper location while also providing improvements in comfort.

In view of the above, a need exists for an improved knee pad that can be worn by military personnel or others during their occupation or during a sporting activity.

SUMMARY

The present disclosure is generally directed to improved knee pad constructions that are to be used in conjunction with a pair of pants for protecting the knees of a wearer. In one embodiment, the knee pad can be integrated into a garment, such as a pair of pants. In an alternative embodiment, the knee pad may be configured to be attached and removed from a garment. When configured to be attached and removed from a garment, the garment may include a plurality of engaging devices at different positions on a leg covering such that the knee pad can be attached at a desired height and position so as to adequately protect the knees of a wearer.

As will be described in greater detail below, the knee pad constructions of the present disclosure offer various advantages and benefits. In particular, knee pad systems in accordance with the present disclosure can be designed not only to fit properly but can also be designed to maximize comfort while providing sufficient functionality for the environment in which the knee pads are used. The knee pad systems of the present disclosure are designed to actively engage the pants of a wearer in order for the knee pad to fit properly in place, no matter the height and size of the user. The knee pads cooperate with a pair of pants so that the knee pads are not only completely functional during kneeling but also do not interfere with the comfort of the pants, minimizing bunching and rubbing issues that are prevalent in prior art designs. The knee pads of the present disclosure can also be designed to be breathable. For instance, the knee pads can include venting channels and/or venting passageways that allow air flow between the outside environment and the knee of the wearer.

In one embodiment, for instance, the present disclosure is directed to a garment that includes two leg coverings. Each leg covering may be comprised of material having a substantially tubular shape configured to accommodate the leg of a wearer.

The garment further includes two knee pads. Each knee pad is positioned over each leg covering. Alternatively, each leg covering may include a knee opening and each knee pad may be positioned within a corresponding knee opening. The knee pads are attached to each corresponding leg covering. In this manner, the knee pad becomes integrated into the garment.

The garment can further include at least one leg gathering device associated with each knee pad. The leg gathering device is configured to releasably gather the leg covering adjacent to a corresponding knee pad for positioning the knee pad over the knee of the wearer. The leg gathering device, for instance, may be positioned above or below each corresponding knee pad. In one particular embodiment, for instance, each leg covering may include a pair of leg gathering devices wherein one leg gathering device is positioned above the knee pad, while the other leg gathering device is positioned below the knee pad. The leg gathering device may comprise a tether that at least partially encircles the leg covering and is attached to the leg covering. The tether may be threaded through a stop device that releasably engages the tether. In order to position the knee pad over the knee, the tether can be pulled by a user causing the leg covering to gather. The stop device can hold the tether at a particular position that causes the knee pad to remain comfortably located over the knee.

In one embodiment, the tether of each leg gathering device can be made from an elastic material. The tether can encircle less than about 270° of each corresponding leg covering and can be attached to the leg covering at each adjacent end.

As described above, in one embodiment, each leg covering may include a pair of leg gathering devices positioned above and below the knee pad. In another embodiment, however, each leg covering may include only a single leg gathering device positioned on one side of the knee pad. Positioned on the opposite side of the knee pad (such as below the knee pad) may be a pair of straps that at least partially encircle the leg covering. In one embodiment, for instance, the straps may include an attachment device for attaching the straps to the leg covering at an adjustable position. For example, each strap may include a hook or loop material while the leg covering may include a corresponding hook or loop material. In this manner, each strap can be adjustably attached to the leg covering using the hook and loop fastener.

In an alternative embodiment, the present disclosure is directed to a garment comprising two leg coverings. Each leg covering can include a front, a back, and two opposing sides. In accordance with the present disclosure, each leg covering can include a first vertical column of engaging devices spaced from a second vertical column of engaging devices. The first and second vertical columns can form corresponding pairs of engaging devices positioned at different heights along the leg covering. As used herein, the height of a leg covering is in reference to a vertical axis running through the leg covering that extends from an opening in the leg covering adjacent the foot of a wearer to a torso portion of the garment.

The garment further includes a pair of knee pads. Each knee pad is for placement over the front of a corresponding leg covering for covering a wearer's knee. Each knee pad includes a pair of opposing attachment devices that are configured to releasably attach to a corresponding pair of engaging devices on the leg covering. The attachment devices on each knee pad are for attaching to a pair of engaging devices on the leg coverings at a desired vertical height for positioning each knee pad over a knee of a wearer.

In one embodiment, the engaging devices on the leg coverings comprise loops, while the attachment devices on the knee pad comprise retaining elements that releasably engage the loops. The retaining elements may comprise, for instance, C-clips or T-shaped members.

In one embodiment, in addition to a first vertical column of engaging devices and a second vertical column of engaging devices, each leg covering further includes a third vertical column of engaging devices and a fourth vertical column of engaging devices. The first and second vertical columns of engaging devices can be positioned over the third and fourth vertical columns of engaging devices. The knee pads can in turn include a second pair of opposing attachment devices in addition to the first pair. The first pair of attachment devices are for engaging with a pair of corresponding engaging devices from the first and second columns. The second pair of attachment devices, on the other hand, can be for engaging a corresponding pair of engaging devices on the third and fourth columns. The first pair of attachment devices, for instance, may secure the top of the knee pad to the leg covering, while the second pair of attachment devices are for securing a bottom of each knee pad to a corresponding leg covering.

Knee pads for use in systems of the present disclosure can also be designed to be breathable independent of the attachment system used. For example, in one embodiment, the knee pad can include an outer shell attached to a cushioning component. The cushioning component can include at least one compressible layer, such as a foam layer, and have a first side that faces a wearer and a second side that faces the outer shell. In accordance with the present disclosure, the first side of the cushioning component can define at least one venting channel that extends to an outer edge of the cushioning component. For example, the first side of the cushioning component may define a plurality of venting channels that extend in different directions from at least the interior of the knee pad to the outer edge. The channels can be provided for allowing heat, such as body heat, to escape from behind the knee pad and also to allow air to flow in between the knee pad and the wearer. In one embodiment, the first side of the cushioning component may define venting channels that extend the entire length and the entire width of the first side.

In addition to venting channels, the knee pad may also include one or more venting passageways. The venting passageways, for instance, may extend in a vertical direction through the width of at least the cushioning component. In one embodiment, for instance, the knee pad may include a plurality of venting passageways that extend from the first side of the cushioning component and terminate at the second side of the cushioning component in between the cushioning component and the outer shell. The knee pad may also include venting passageways that extend not only through the cushioning component but also through the outer shell. In one embodiment, for instance, the knee pad may include venting passageways that only extend through the cushioning component in combination with venting passageways that extend through the cushioning component and through the outer shell.

For venting passageways that terminate between the outer shell and the cushioning component, in one embodiment, the second side of the cushioning component may define various venting channels that extend from the venting passageways to an edge of the cushioning component. The venting passageways located on the second side, for instance, may provide air flow from the outside environment and into the venting passageways, while the outer shell covers the passageway for preventing dirt or other contaminants from entering the passageway.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
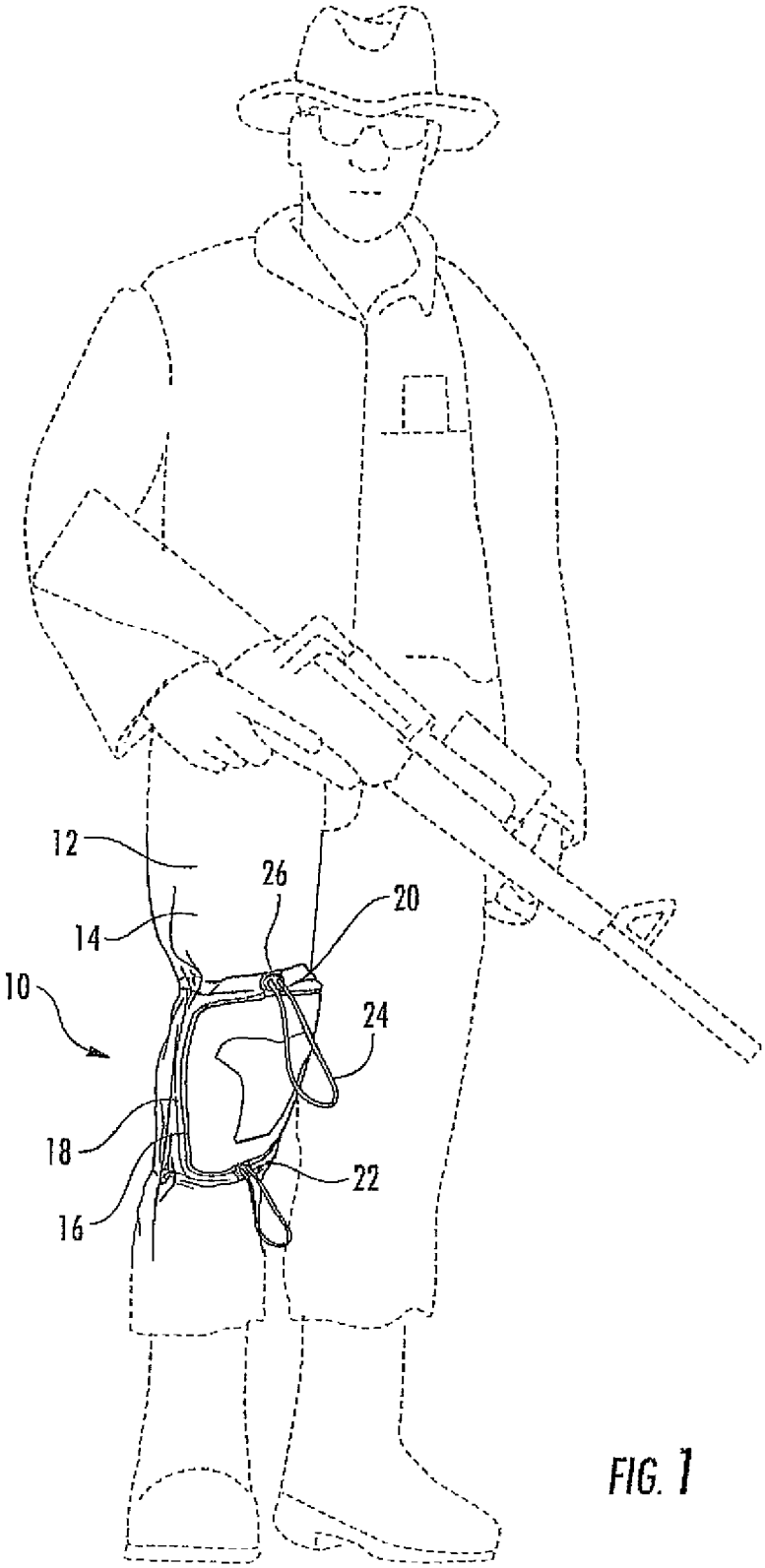
FIG. 1 is a perspective view of one embodiment of a garment made in accordance with the present disclosure including a knee pad.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to various embodiments of knee pads that are to be used in conjunction with a garment for protecting the knees of a wearer. As will be described in greater detail below, in one embodiment, the knee pad can be completely integrated into the garment. In an alternative embodiment, a knee pad is designed that can be easily installed and removed from a garment. Of particular advantage, the knee pad can be installed and removed using an adjustable attachment system so that the knee pad is properly positioned over the knees of a wearer.

Knee pads made in accordance with the present disclosure offer various benefits and advantages. For instance, the knee pads can be designed to be properly positioned on a garment while remaining comfortable to the wearer. Thus, knee pad systems in accordance with the present disclosure provide great fit and functionality in combination with remaining comfortable to wear. Of particular advantage, knee pad systems in accordance with the present disclosure beneficially cooperate with the pants that they are used in conjunction with. In particular, the knee pads actively engage the pants to place the knee pads in a proper position, independent of the size and height of the wearer, and without substantially compromising comfort.

In one embodiment, the knee pads can be designed without any straps that extend around the back of the legs that may either rub on the legs or apply pressure to the legs. In addition, the knee pads are used in conjunction with attachment means and/or positioning means so that the position of the knee pads can be adjusted based upon the wearer.

Referring to FIGS. 1-6, one embodiment of a knee pad 10 made in accordance with the present disclosure is shown. In this embodiment, the knee pad 10 is integrated into a garment 12. The garment 12 may comprise a pair of pants, a body suit, or any other suitable garment that is intended to cover the legs of a wearer. In the embodiment illustrated in FIG. 1, the garment 12 includes only a single knee pad 10. It should be understood, however, that the garment may include a pair of corresponding knee pads to cover both knees of the wearer.

The knee pad 10 as shown in FIG. 1 can have various constructions in accordance with the present disclosure. In general, the knee pad 10 can include an outer shell attached to a cushioning layer. The outer shell can be rigid or flexible. The cushioning layer, on the other hand, can be made from any resilient material, such as a foam. In one embodiment, the knee pad can include multiple cushioning layers made from different materials.

In the embodiment illustrated in FIGS. 1-6, the knee pad 10 is formed from a unitary outer shell. It should be understood, however, that the knee pad may also be articulated. For instance, in one embodiment, the knee pad may include multiple segments that are joined together along hinges. For instance, in one embodiment, the knee pad may include a primary segment that overlaps the knee of a wearer. The primary segment may be connected to a second or secondary segment along a hinge. In this manner, the knee pad may move with the wearer as the knee is bent.

As shown in FIG. 1, the garment 12 includes a leg covering 14 to which the knee pad 10 is connected. The leg covering 14 can be made from any suitable material and may generally have a tubular shape that extends from the torso of the wearer to the foot of the wearer in a vertical direction. In this embodiment, the leg covering 14 defines a knee opening 16. As shown, the knee pad 10 is installed within the knee opening 16 so as to become integrated into the garment 12.

In one embodiment, for instance, the knee pad 10 may define a perimeter. The knee opening 16, on the other hand, includes a periphery that surrounds the opening. In accordance with the present disclosure, the perimeter of the knee pad 10 can be attached to the periphery of the knee opening 16. The knee pad can be connected to the leg covering in any suitable manner. For instance, as shown in the figures, the knee pad 10 may be connected to the leg covering 14 using stitches 18. Instead of or in addition to stitches 18, however, the knee pad may be attached to the leg covering using an adhesive or through the use of any suitable attachment mechanism.

In the embodiment illustrated, the perimeter of the knee pad 10 is positioned below the periphery of the knee opening 16. In this manner, the knee pad 10 fills the knee opening 16 and protrudes from the garment. Placing the knee pad 10 below the periphery of the knee opening 16 provides for an overall aesthetically appealing look. It should be understood, however, that in an alternative embodiment, the perimeter of the knee pad may be placed on the top of the exterior surface of the leg covering and attached.

Figure 13:
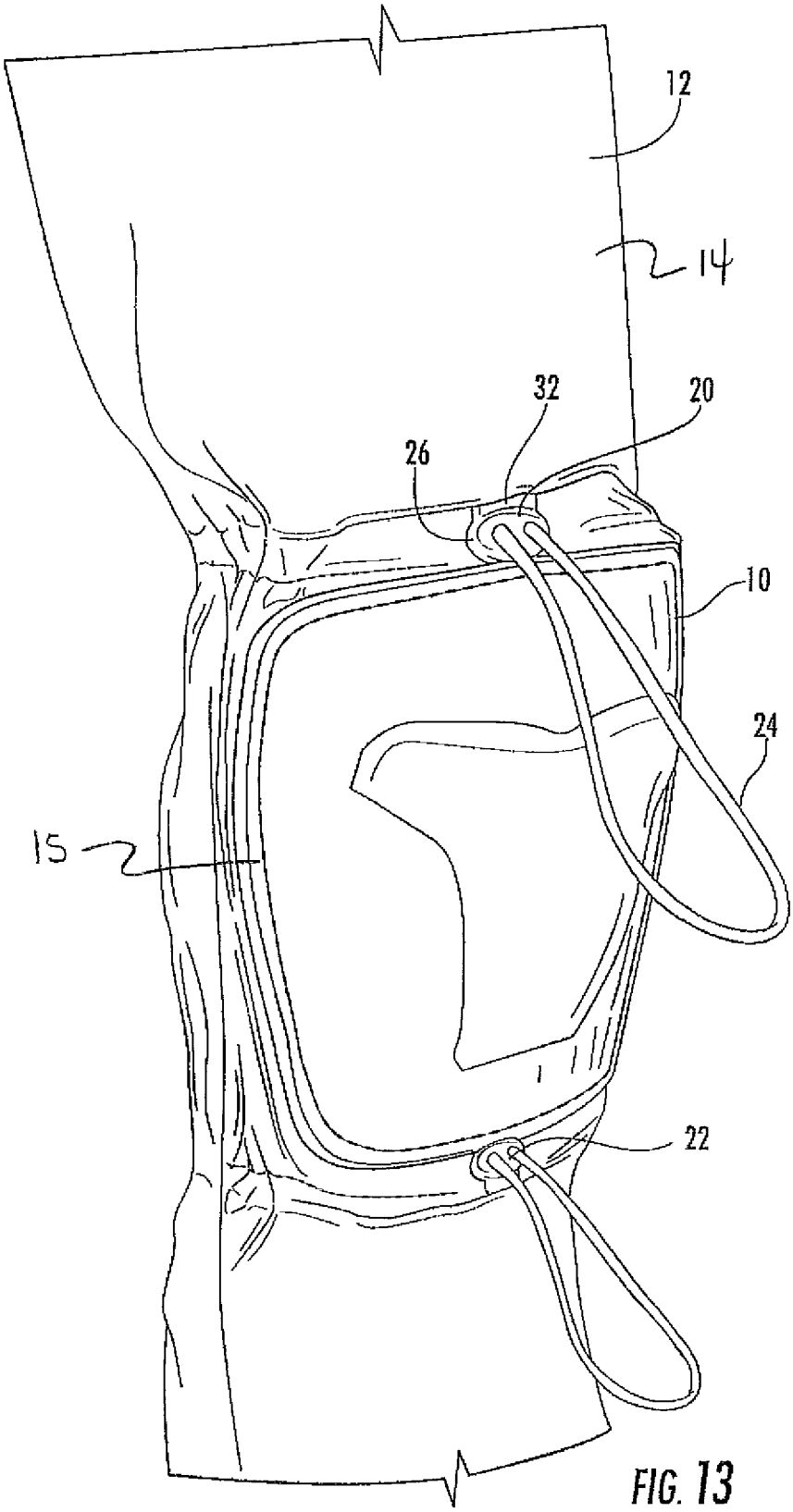
FIG. 13 is a perspective view of another embodiment of a garment made in accordance with the present disclosure including a knee pad.

Referring to FIG. 13, an alternative embodiment of a knee pad 10 is shown. Like reference numerals have been used to indicate similar elements. In the embodiment illustrated in FIG. 13, the leg covering 14 does not include a knee opening 16. Instead, the knee pad 10 is affixed to the outside surface of the leg covering 14. As shown, the knee pad 10 includes a perimeter 15 that is stitched to the leg covering 14.

In order to properly position the knee pad 10, the garment 12 further includes at least one leg gathering device associated with the knee pad. The leg gathering device is configured to releasably gather the leg covering adjacent to the knee pad for positioning the knee pad over a knee of the wearer. One embodiment of a leg gathering device is illustrated in FIGS. 1-6 and 13.

Figure 2:
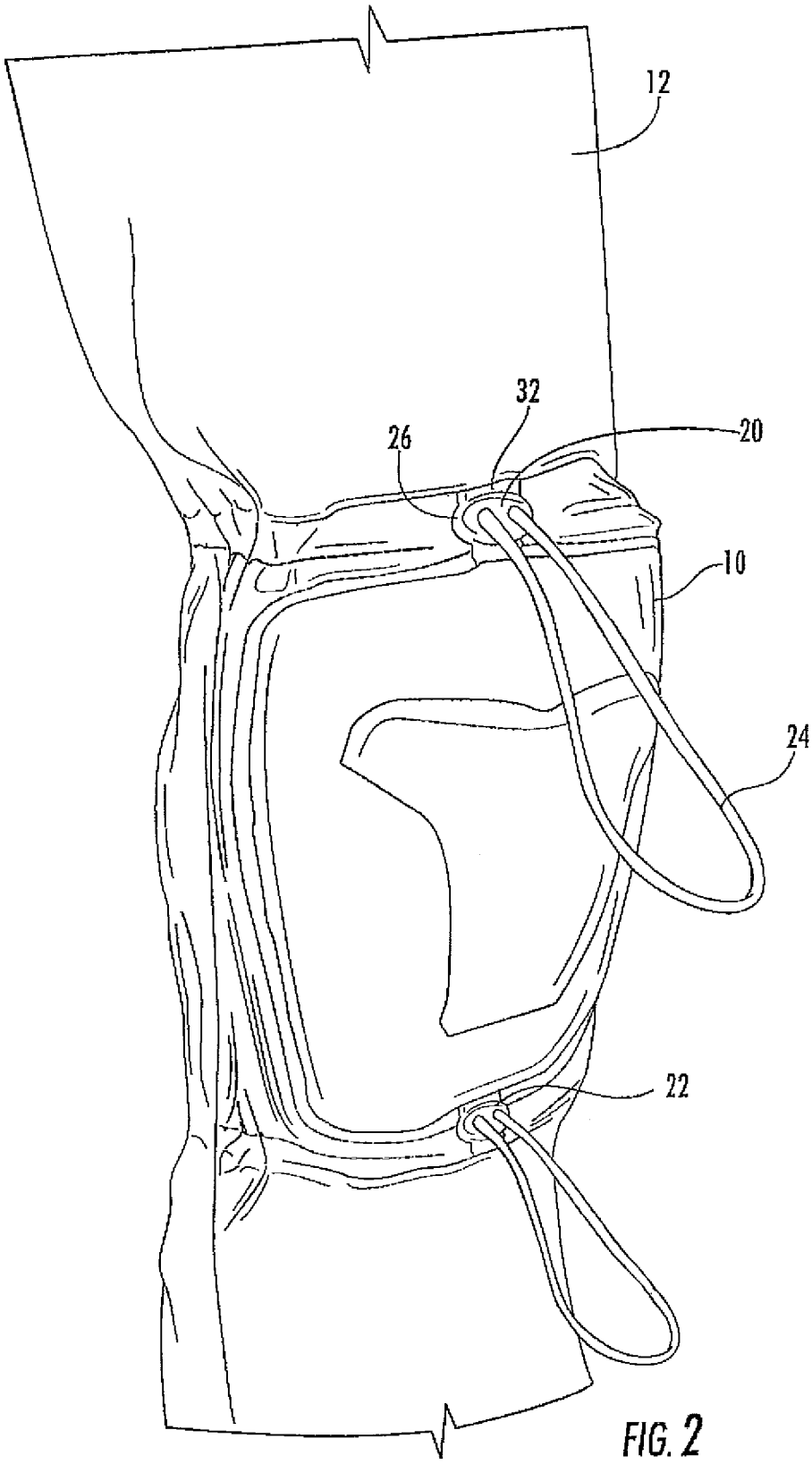
FIG. 2 is an enlarged perspective view of the knee pad illustrated in FIG. 1.

For example, referring particularly to FIG. 2, in the embodiment illustrated, the garment 12 includes a first leg gathering device 20 positioned above the knee pad 10 and a second leg gathering device 22 positioned below the knee pad 10. The leg gathering device 20, for instance, includes a tether 24 that is attached to the leg covering 14 and is threaded through a stop device 26. The tether 24 at least partially encircles the leg covering 14 adjacent to the knee pad 10. For instance, in one embodiment, the tether 24 is made from an elastic material and is connected to the leg covering 14 at opposite sides.

Figure 4:
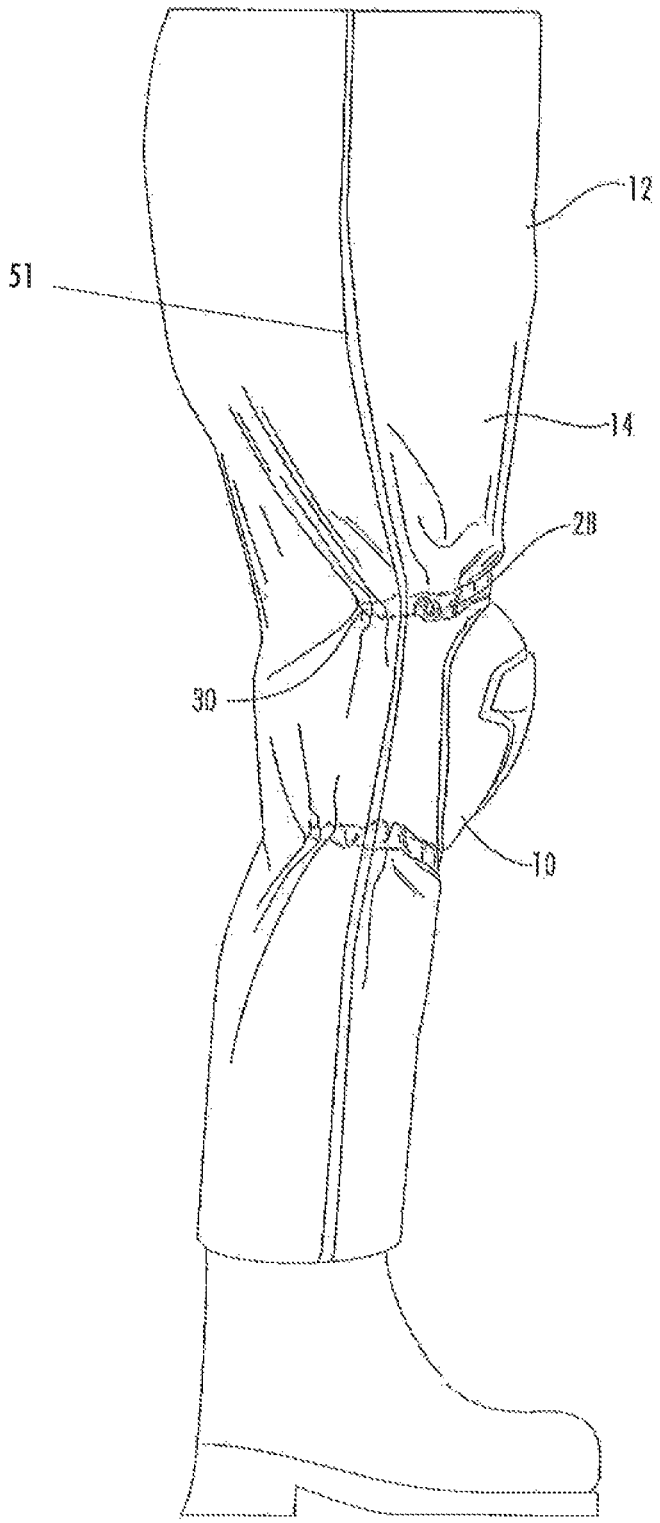
FIGS. 4 and 5 are side views of the knee pad illustrated in FIG. 1.
Figure 5:
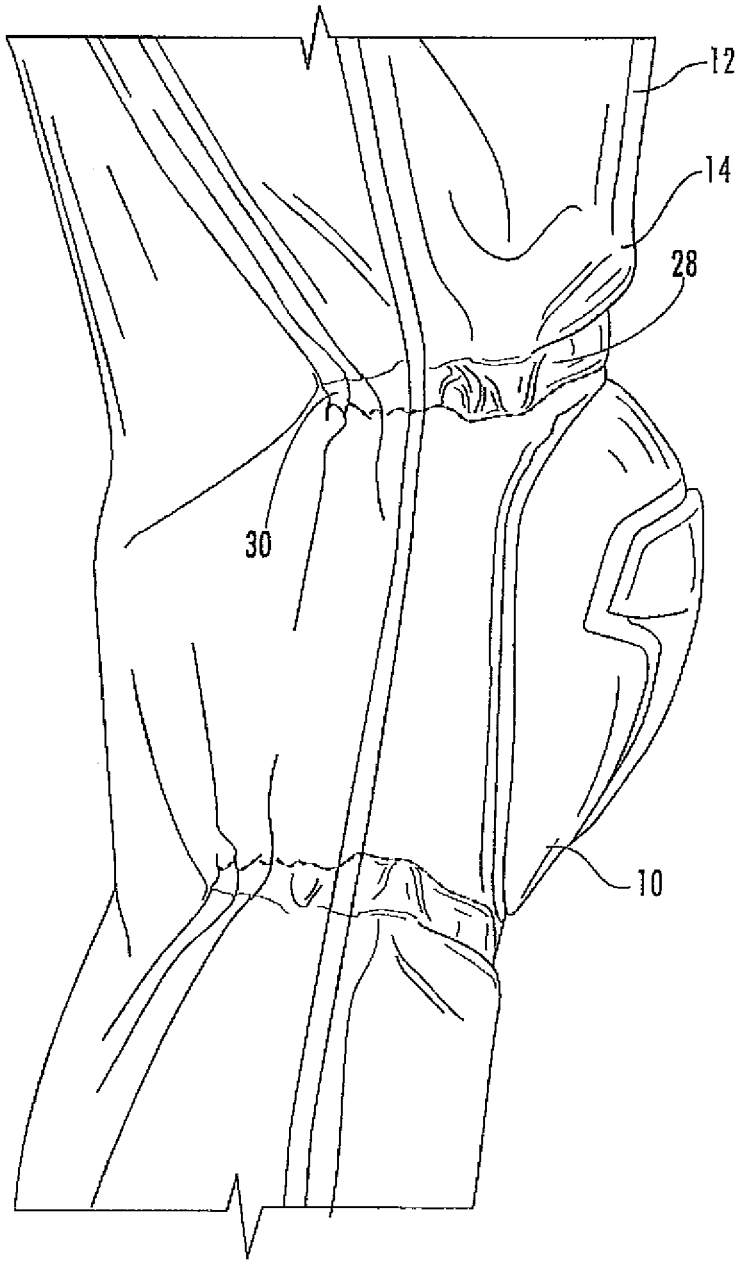
Figure 6:
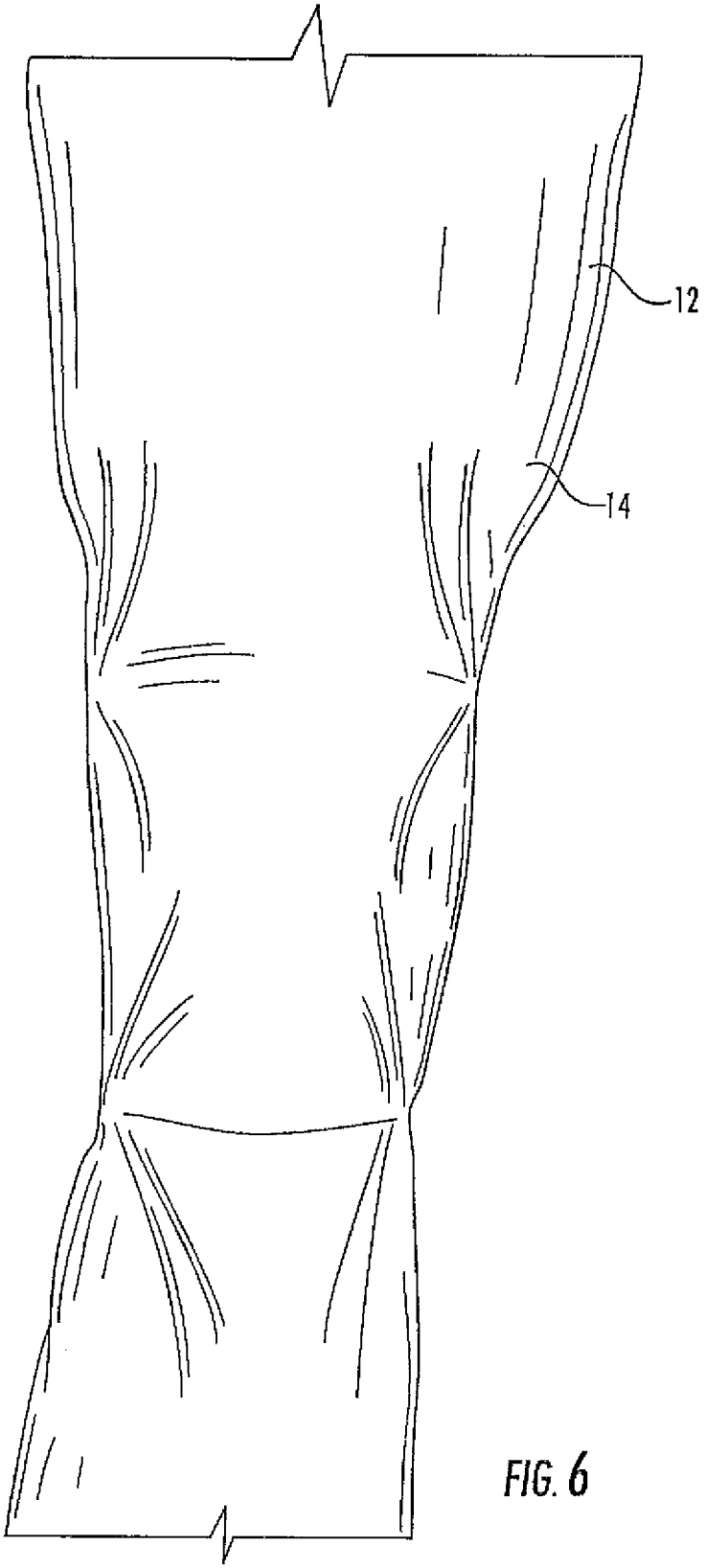
FIG. 6 is a back view of the garment illustrated in FIG. 1.

Referring to FIGS. 4 and 5, a side view of the leg covering 14 is shown in more detail. The tether 24 may include a first end and a second and opposite end that are each attached to the leg covering 14. In one particular embodiment, for instance, as shown in FIGS. 4 and 5, the leg covering 14 can define a passageway 28 through which the tether 24 is threaded. At an end 30 of the passageway 28, an end of the tether 24 can be secured to the leg covering 14. In one embodiment, for instance, the tether can be stitched to the leg covering. Alternatively, the tether 24 can be bonded to the leg covering using an adhesive. As shown in FIGS. 4 and 5, the end 30 of the passageway 28 generally lies on the side of the leg covering. In this manner, the tether 24 encircles less than about 270° of the leg covering 14, such as less than about 250° of the leg covering. In general, the tether encircles the leg covering in an amount of at least about 100°, such as in an amount of at least about 120°, such as in an amount of at least about 150°.

Figure 3:
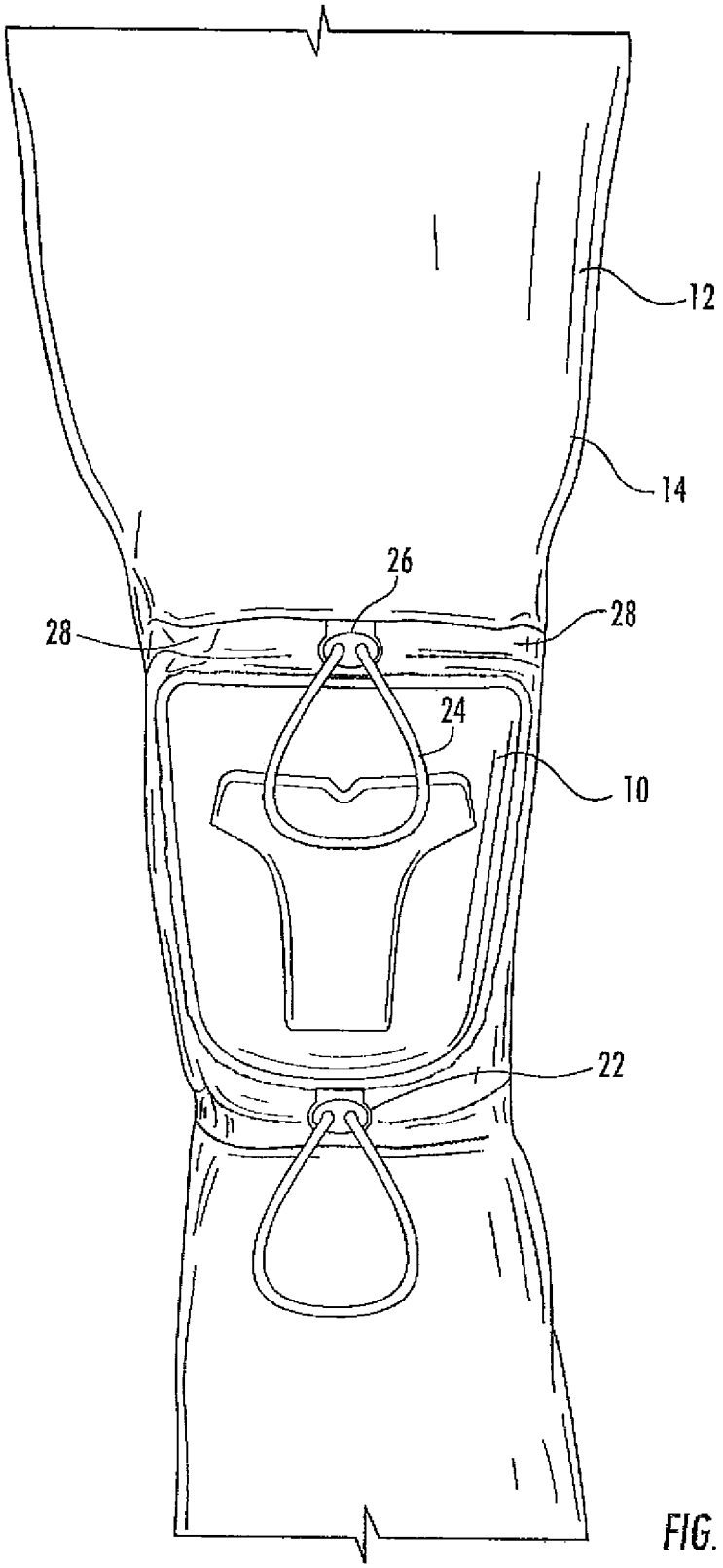
FIG. 3 is a front plan view of the knee pad illustrated in FIG. 1.

Referring back to FIG. 2, the stop device 26 can include a tether engaging device 32 that releasably engages the tether 24 when released by a user, such as by pressing on a spring biased lever. In this manner, the tether 24 can be pulled by a user causing the leg covering 14 to gather on each side of the leg adjacent to the knee pad 10. Pulling on the tether 24 tightens the leg covering 14 adjacent to the knee pad causing the knee pad 10 to position directly over the knee of the wearer. For example, as shown in FIGS. 3 and 4, the garment 12 includes two leg gathering devices 20 and 22. When the tethers are pulled on each leg gathering device, the leg covering 14 gathers above and below the knee pad which naturally causes the knee pad to be positioned in the correct location over the knee with virtually no discomfort. As shown, the leg covering 14 has a tendency to gather in a uniform manner without causing the leg covering to gather all in a single location that may cause discomfort to the wearer. In addition, referring to FIG. 6, the back of the leg covering 14 is shown. Since the tethers do not completely encircle the leg covering, as shown, the back of the leg covering is not gathered further increasing the comfort. Thus, the knee pad 10 is properly positioned without having to extend straps around the back of the wearer's leg.

As described above, the tether engaging device 32 of the stop device 26 is designed to releasably engage the tether 24. In this manner, when the knee pad 10 is not needed, the tethers 24 can be loosened such that no gathering occurs in the leg covering 14. Of particular advantage, by loosening the tethers, the knee pad 10 drapes normally on the leg covering and does not interfere with normal walking, jogging or other movement of the garment Consequently, the knee pad 10 does not provide any significant discomfort to the wearer when the knee pad is not being used, such as when the wearer is not kneeling.

As shown in FIG. 1, the knee pad 10 is particularly well suited for use in conjunction with uniforms worn by the armed services or other military personnel. The knee pad 10, for instance, can be incorporated into battle dress uniforms, riot gear garments, police garments, firefighter garments, and the like. The knee pad 10, however, is equally well suited for use with athletic clothing. For instance, the knee pad 10 may also be incorporated into football jerseys, hockey jerseys, garments worn during skateboarding, roller skating, and the like. The knee pad 10 can also be integrated into garments worn by workers who normally kneel during their occupation, such as carpet installers, roof installers, and the like.

In the embodiment illustrated in FIG. 1, the garment 12 includes a first leg gathering device and a second leg gathering device positioned on opposite sides of the knee pad 10. In other embodiments, however, only a single leg gathering device may be included in the garment. For instance, the leg gathering device may be positioned above the knee pad or may be positioned below the knee pad. The single leg gathering device may be used in association with other structures to secure the knee pad.

For example, referring to FIGS. 17-21, another embodiment of a garment 12 made in accordance with the present disclosure is shown. Like reference numerals have been used to indicate similar elements. In the embodiment illustrated in FIGS. 17-21, a knee pad 10 is shown in association with a leg covering 14. In accordance with the present disclosure, the garment includes a leg gathering device 20 positioned above the knee pad 10. The leg gathering device 20 is as described above.

In the embodiment illustrated in FIGS. 17-21, however, a plurality of straps are located adjacent the bottom end of the knee pad 10 and are used in conjunction with the leg gathering device 20. As shown particularly in FIGS. 18 and 20, in this embodiment the garment includes a first strap 40 positioned on one side of the knee pad with a second strap 42 positioned on the opposite side of the knee pad. Straps 40 and 42 may be integral in one embodiment and thus may comprise a single strap that extends through the garment. The straps 40 and 42 are for securing the knee pad to the leg of the wearer when desired in an adjustable manner.

For example, each strap 40 and 42 may be placed in association with an attachment device for attaching the straps to the leg covering 14 at an adjustable position. In the embodiment illustrated in the figures, for instance, the attachment device comprises a hook and loop fastener. For example, strap 40 includes hook material 44, while strap 42 includes hook material 45. Positioned on the back of the leg covering 14 are corresponding loop material patches 46 and 47. In this manner, a wearer can releasably attach each strap to the leg covering. The loop material patches 46 and 47 can have a size that allows for adjustability.

Figure 18:
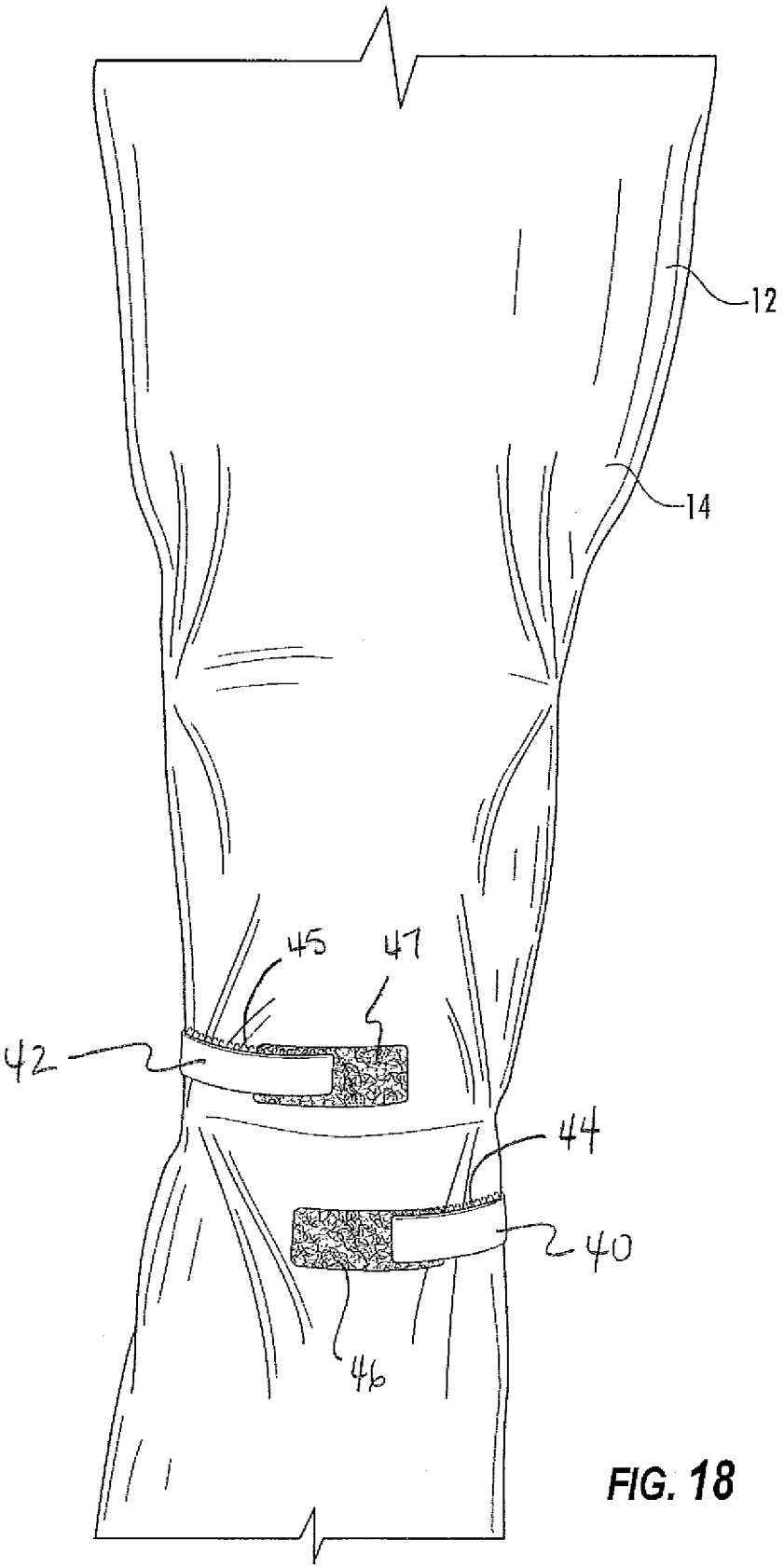
FIG. 18 is a back view of the garment illustrated in FIG. 17.
Figure 19:
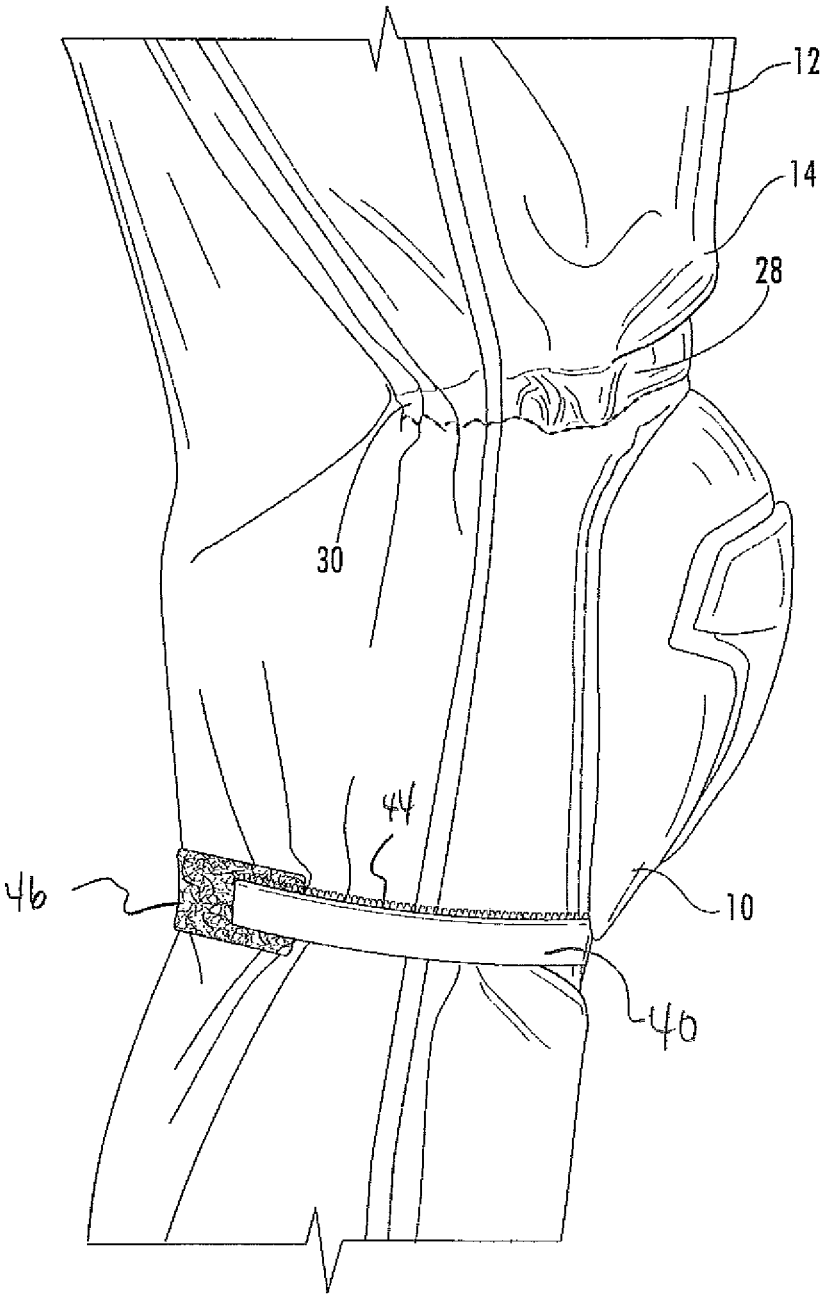
FIG. 19 is a partial side view of the garment illustrated in FIG. 17.
Figure 20:
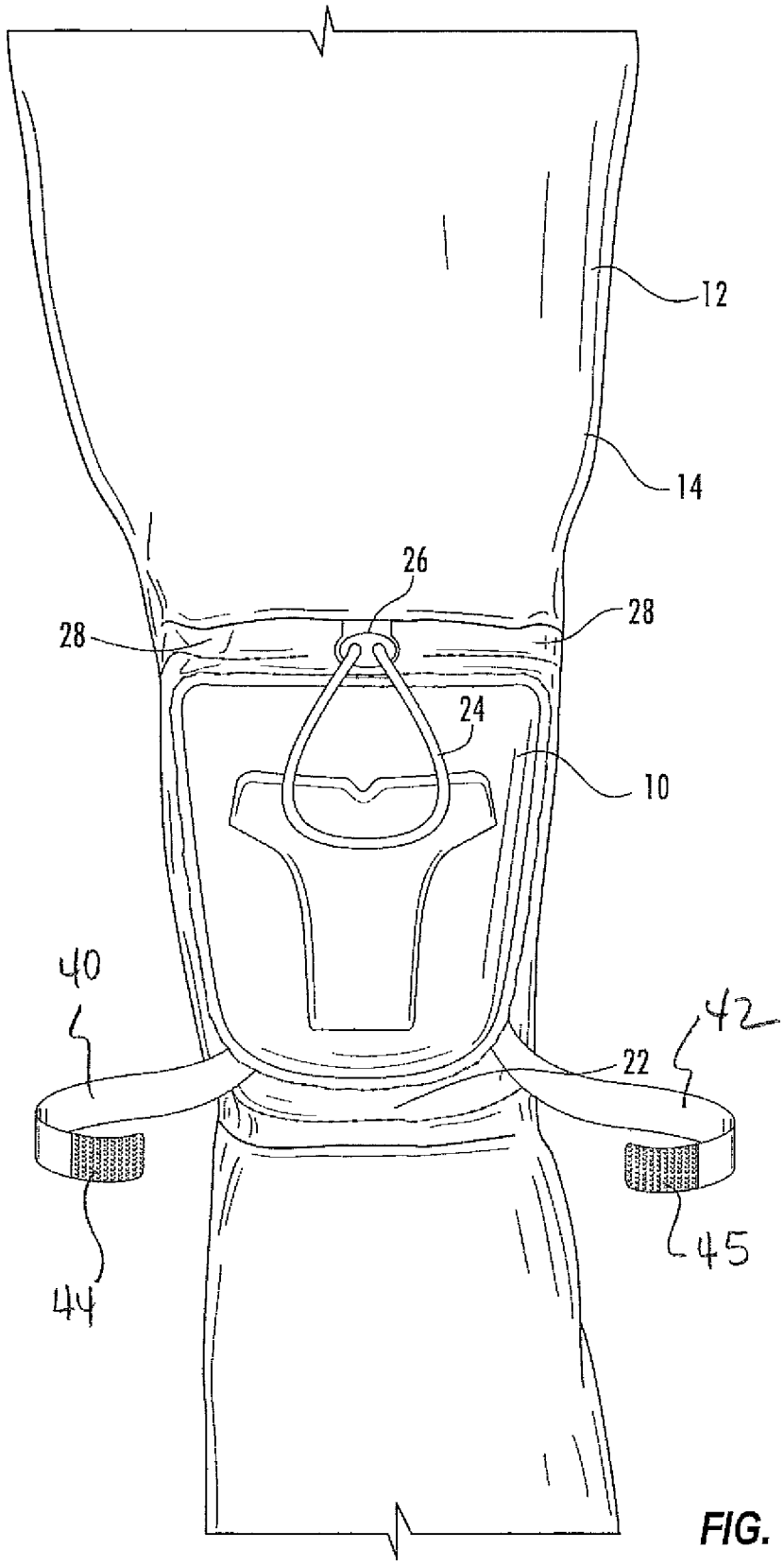
FIG. 20 is a front plan view of the garment illustrated in FIG. 17 including the knee pad.
Figure 21:
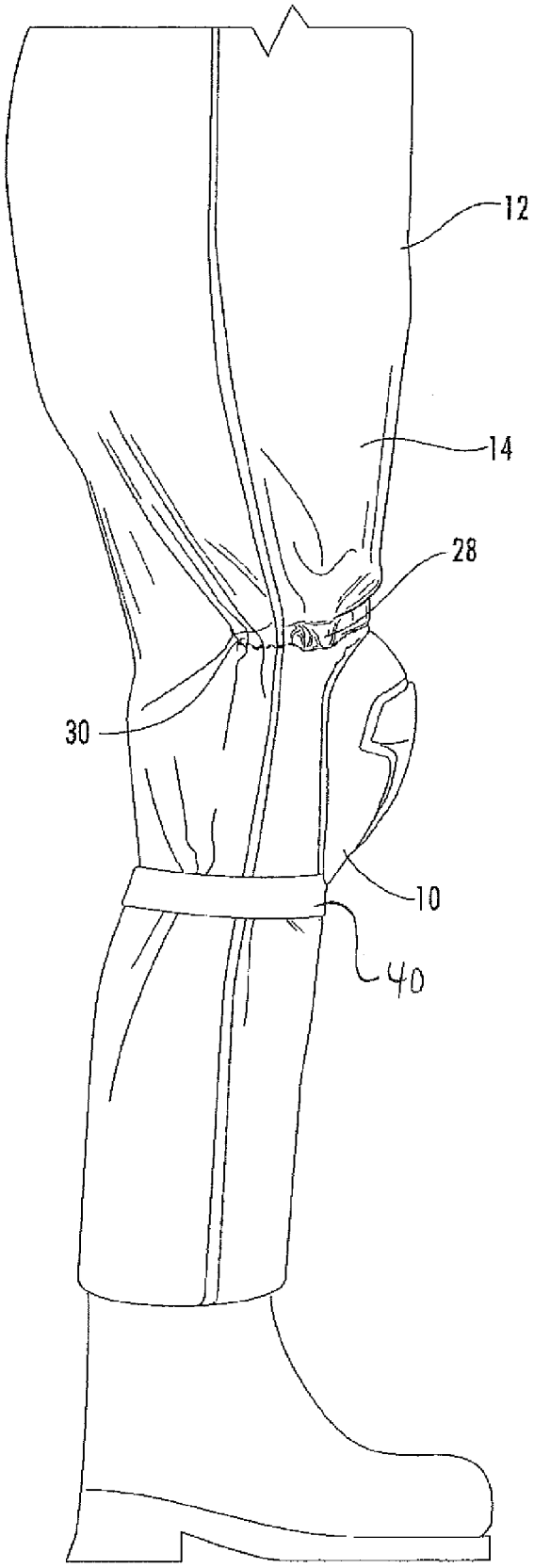
FIG. 21 is a side view of the garment illustrated in FIG. 17.

In the embodiment illustrated in FIG. 18, one hook and loop fastener is positioned above the other hook and loop fastener. In other embodiments, however, both straps may attach to the same loop material on the leg covering. The embodiment illustrated in FIG. 18, however, provides for more adjustment and may provide more comfort.

In still another embodiment, the straps 40 and 42 may be configured to hook together.

Figure 7:
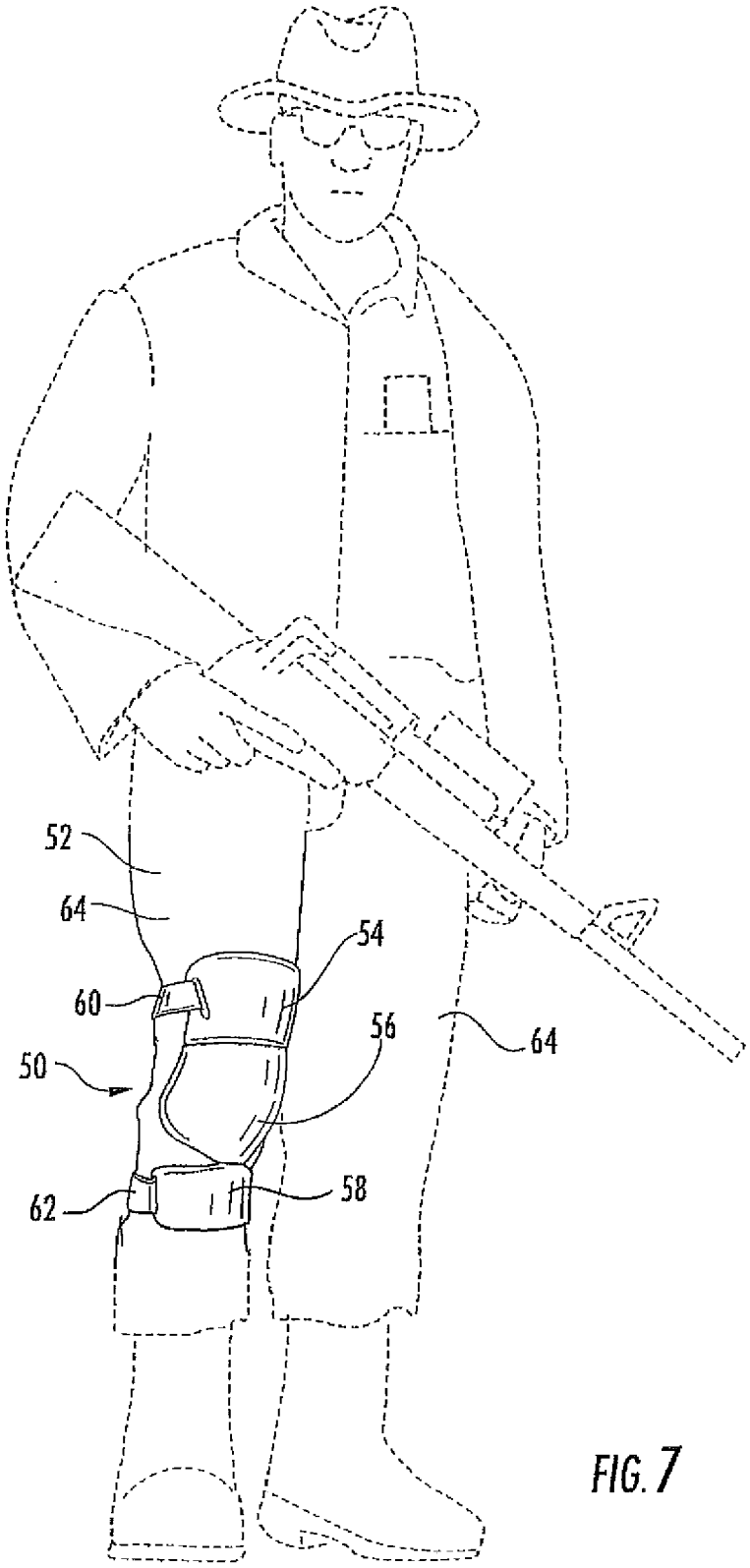
FIG. 7 is a perspective view of an alternative embodiment of a garment including a knee pad in accordance with the present disclosure.
Figure 8:
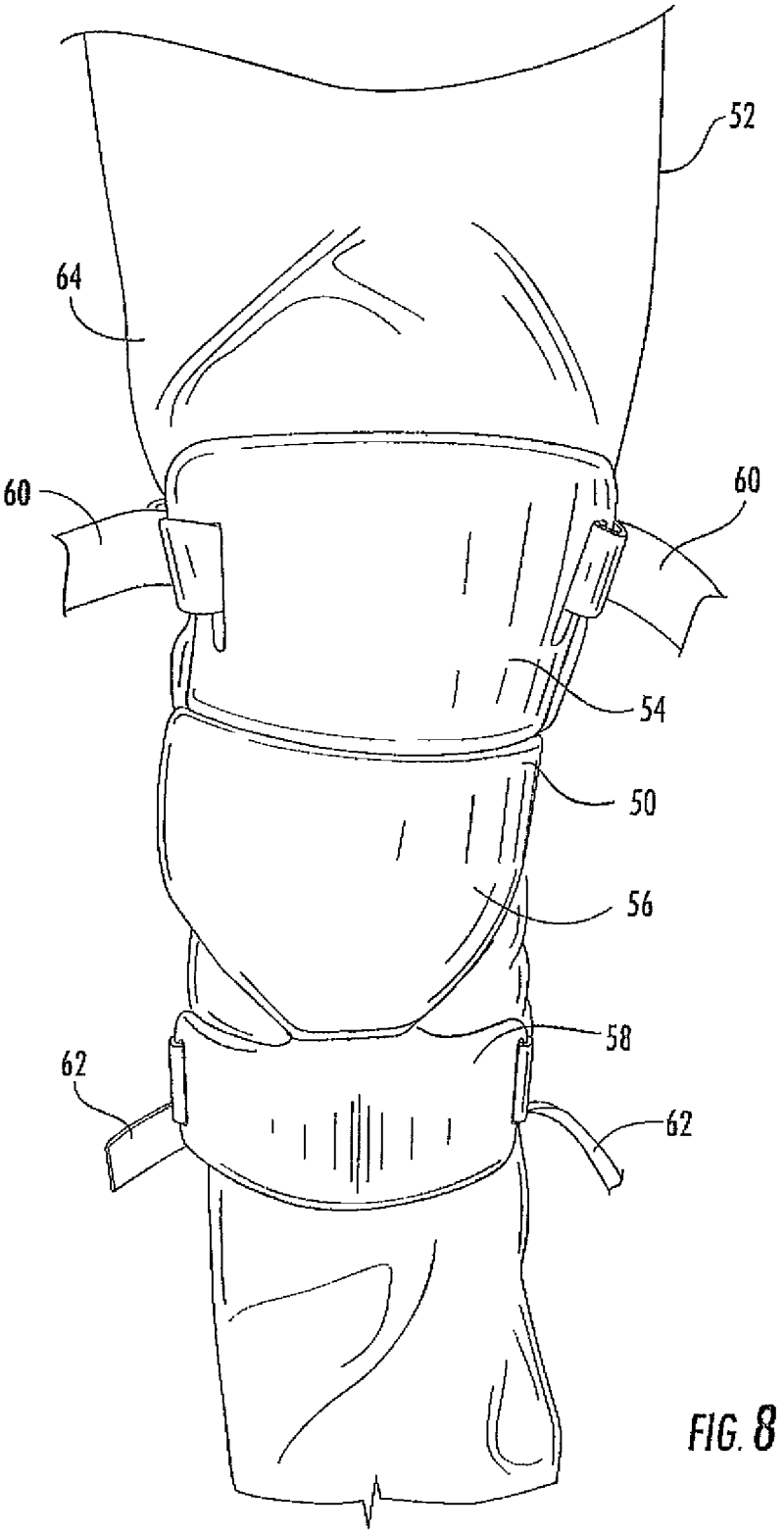
FIG. 8 an enlarged perspective view of the knee pad illustrated in FIG. 7.
Figure 9:
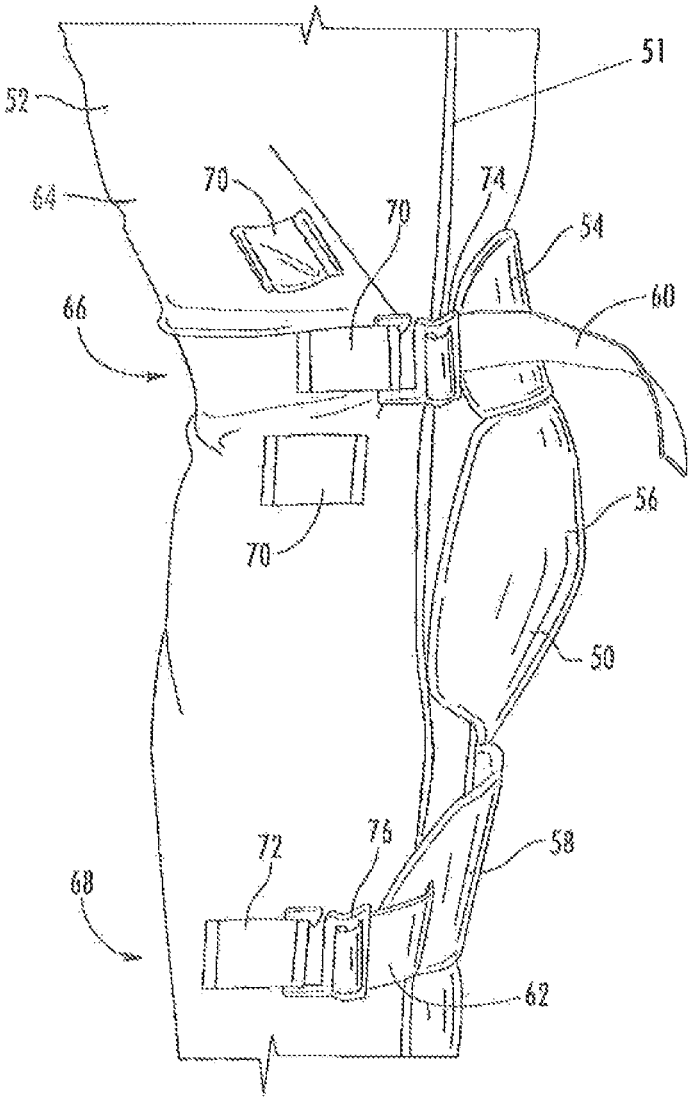
FIG. 9 is a side view of one embodiment of the knee pad Illustrated in FIG. 7.

Referring to FIGS. 7-9, another embodiment of a knee pad 50 made in accordance with the present disclosure is shown. In this embodiment, the knee pad 50 is designed to be attached and removed from a garment 52.

The knee pad 50 as shown in FIG. 7 can be similar in construction to the knee pad illustrated in FIG. 1. In the embodiment in FIG. 7, however, an articulated knee pad is shown. In particular, the knee pad 50 includes a first segment 54, a second segment 56, and a third segment 58. The first segment 54 is joined to the second segment 56 along a hinge or a joint. Similarly, the second segment 56 is attached to the third segment 58 also along a hinge or a joint. As shown, the second segment 56 is for covering the kneecap of a wearer; while the first segment 54 and the third segment 58 serve to support the second segment and move with the user. The first segment 54 is connected to a pair of straps 60, while the third segment 58 is attached to a pair of straps 62. The straps 60 and 62 are for attachment to the garment 52 as will be described in greater detail below.

As shown in FIGS. 7, 8 and 9, the garment 52 includes a pair of leg coverings 64. The leg coverings 64 extend in a vertical direction from the torso of the wearer to the feet of the wearer. Each leg covering 64 defines a circumference and includes a front, a back and two opposing sides 51 (see also FIG. 4). For the embodiment depicted in FIGS. 7, 8, and 9, the opposing sides are each configured as a side seam of the respective leg covering 64. In FIG. 7, a single knee pad 50 is shown attached to the leg covering 64. It should be understood, however, that a pair of identical knee pads may be attached to each of the corresponding leg coverings if desired.

As shown particularly in FIG. 9, each side of the leg covering 64 includes a vertical column of engaging devices. The engaging devices are for attachment to the knee pad 50. For instance, in one embodiment, the leg covering 64 can include a first column of engaging devices on one side opposite a second column of engaging devices on an opposite side of the leg covering at substantially the same vertical height. The leg covering 64 can further include a third column of engaging devices on one side opposite a fourth column of engaging devices on an opposite side of the leg covering at locations in alignment with the third column of engaging devices. The first and second columns of engaging devices can be positioned over the third and fourth columns of engaging devices. In FIG. 9, for instance, the first column of engaging devices 66 is shown above a third column of engaging devices 68.

The engaging devices 66 and the engaging devices 68 are for making a releasable attachment to the straps 60 and 62 on the knee pad 50. In this regard, any suitable attachment mechanism may be used for releasably attaching the straps 60 and 62 to the engaging devices 66 and 68. In the embodiment illustrated, for instance, the first column of engaging devices 66 comprises loops 70 while the third column of engaging devices 68 comprises loops 72. The straps 60 and 62, on the other hand, are connected to attachment devices 74 and 76. In this embodiment, the attachment devices 74 and 76 comprise clips, such as C-clips.

Figure 11A:
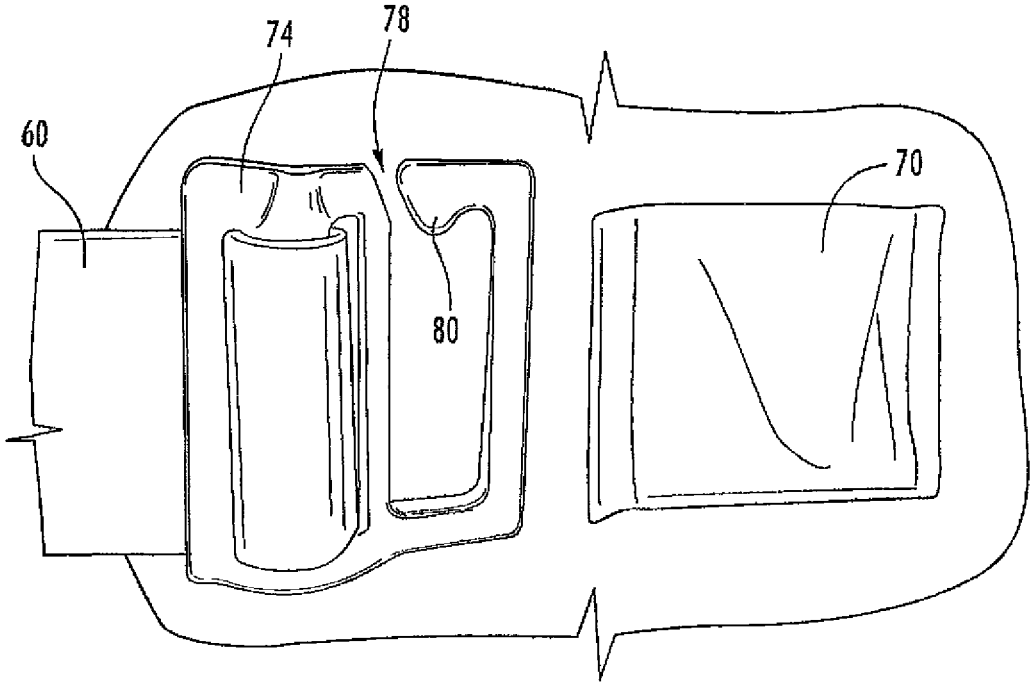
FIGS. 11A and 11B are plan views of one embodiment of an attachment structure that may be used with the knee pad Illustrated in FIG. 7.
Figure 11B:
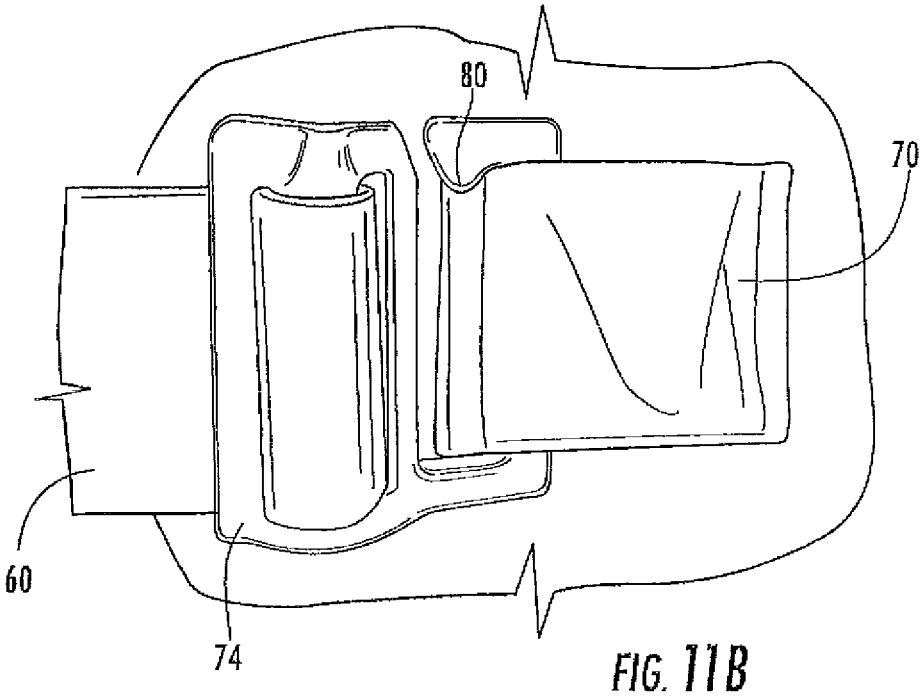

Referring to FIGS. 11A and 11B, the C-clips 74 in conjunction with the loops 70 are shown in greater detail. As illustrated, the clip 74 defines an opening 78 for placing the loop into the interior of the clip as shown particularly in FIG. 1B. In order to hold the loop 70 in place, the clip 74 can include a retaining member 80 that comprises a projection that projects towards the interior of the clip. As shown in FIG. 11B, the retaining member 80 wraps around the loop 70 and prevents the clip and loop from disengaging undesirably.

As shown in FIG. 9, the clip 74, in this embodiment, is also adapted to engage the strap 60 that is attached to the knee pad 50. The strap 60 can be adjustable for tightening or loosening the knee pad 50 as desired. The strap 60 can be made from a non-elastic material or from an elastic material. When made from an elastic material, it may not be necessary to make the strap adjustable.

As described above, the leg covering 64 of the garment 52 includes corresponding columns of engaging devices. In the embodiment illustrated, for instance, the leg covering 64 includes first and second columns of engaging devices located adjacent to the top of the knee pad 50 and includes third and fourth columns of engaging devices on opposing sides of the leg covering adjacent to the bottom of the knee pad 50. Each column includes a plurality of engaging devices that are spaced at different vertical heights on the leg covering 64. In this manner, the garment 52 provides multiple attachment points on opposing sides of the leg covering for allowing vertical adjustability of the knee pad 50 depending upon the size and height of the wearer. In the embodiment illustrated, for instance, the first column of engaging devices comprises three loops 70. It should be understood, however, that each column may include from about two to about ten different engaging devices, such as from about two to about five engaging devices located in a column.

As shown in FIG. 9, the attachment system of the present disclosure for the knee pad 50 not only provides for adjustment in the vertical position of the knee pad but also allows for securement of the knee pad to the garment without the need for any straps that extend around the back of the leg of the wearer. The attachment system provides for increased comfort as the load put on the straps is distributed along the entire back panel of the leg covering. Further, as shown in FIG. 9, the knee pad 50 can be installed on the garment without causing the garment to bunch or gather in an uncomfortable manner.

Figure 10:
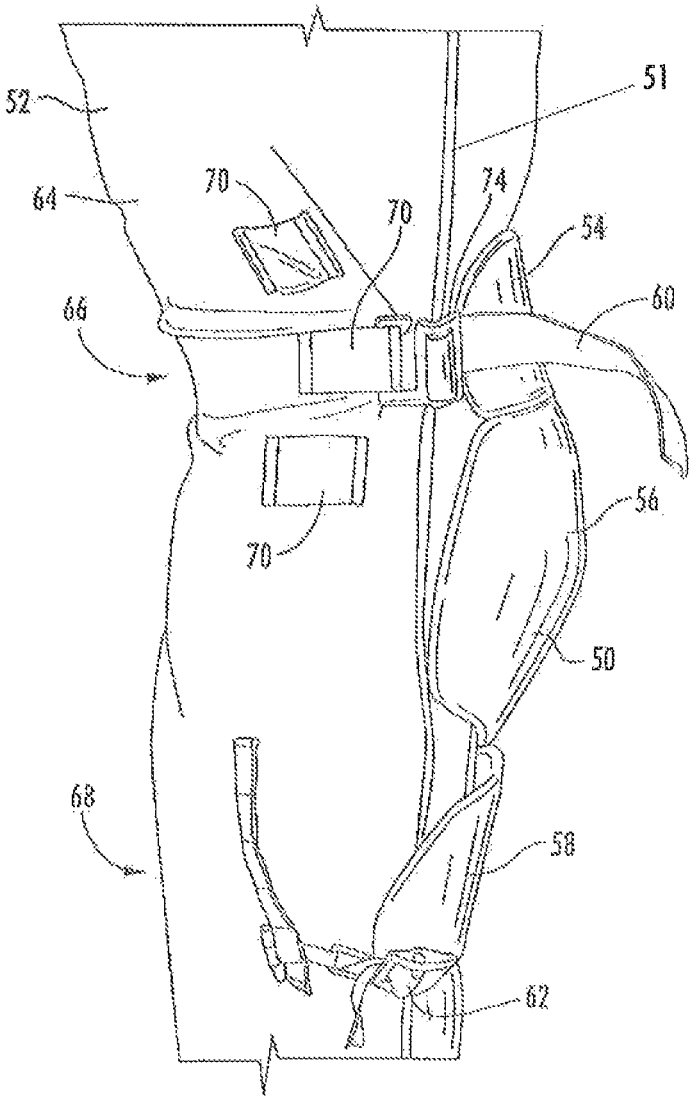
FIG. 10 is a side view of another alternative embodiment of a knee pad made in accordance with the present disclosure.
Figure 12A:
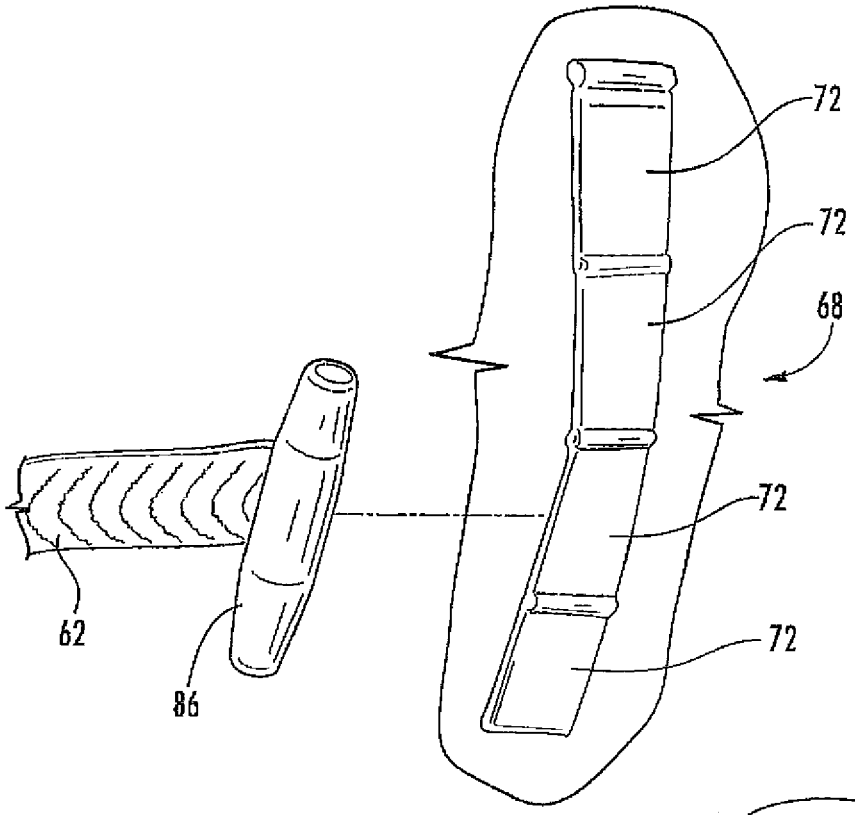
FIGS. 12*a* and 12B are perspective views of another embodiment of an attachment system that may be used with the knee pad illustrated in FIG. 7.
Figure 12B:
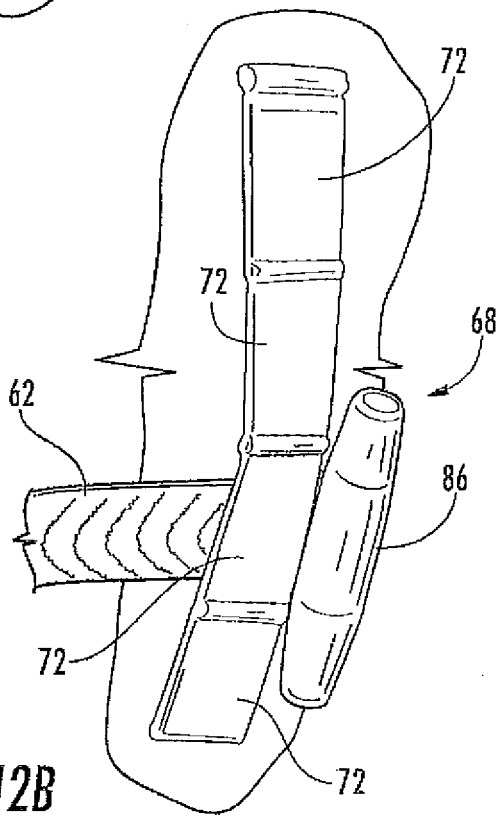

Referring now to FIGS. 10, 12A and 12B, another embodiment of a knee pad 50 made in accordance with the present disclosure is shown. Like reference numerals have been used to indicate similar elements. In the embodiment illustrated in FIG. 10, the knee pad 50 is similar in design and construction to the knee pad illustrated in FIG. 9. In the embodiment illustrated in FIG. 10, however, the attachment system for the lower or third segment 58 of the knee pad 50 is different than the attachment system for the top of the knee pad. In this embodiment, for instance, the third column of engagement devices comprises an array of loops 72. The loops are made from a single piece of material creating a plurality of loops that are directly adjacent to one another in a vertical column. As particularly shown in FIGS. 12A and 12B, instead of a clip, the knee pad 50 includes a T-shaped member 86 that is designed to engage a corresponding loop 72. As shown in FIGS. 12A and 12B, for instance, the T-shaped member 86 is attached to an end of the strap 62. The T-shaped member 86 can be inserted into one of the loops 72 by being rotated 90°. Once inserted into the loop 72, the T-shaped member 86 can be released, thus releasably locking the knee pad 50 into place.

In the embodiment illustrated in FIG. 10, the attachment system at the top of the knee pad is different than the attachment system at the bottom of the knee pad. This design may be desirable in some applications for providing a proper amount of adjustability. In other embodiments, however, the T-shaped member can be positioned at both the top and the bottom of the knee pad.

It should be understood, however, that any suitable releasable engagement mechanism can be used in association with the knee pad 50.

Figure 14:
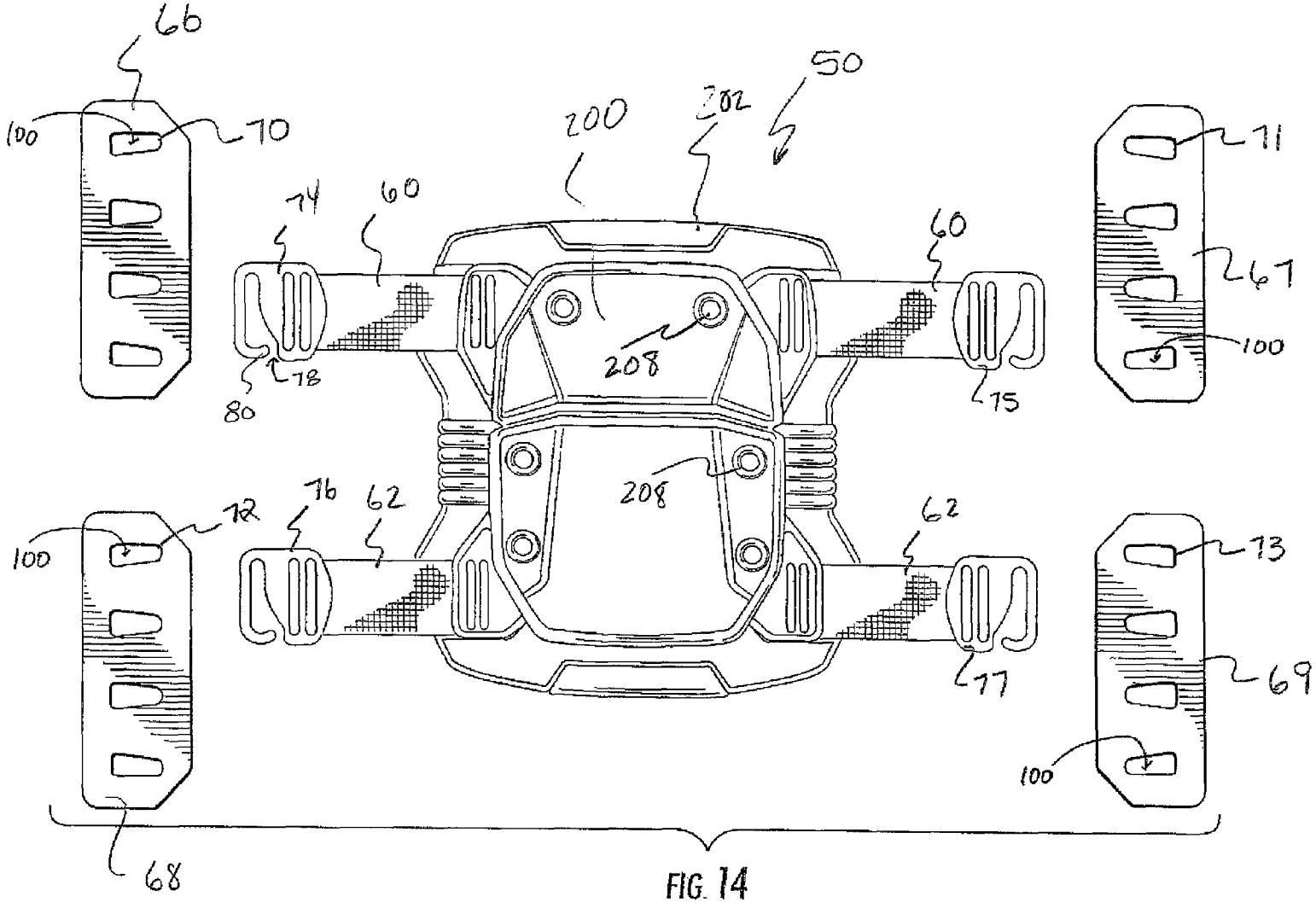
FIG. 14 is a plan view of another embodiment of a knee pad made in accordance with the present disclosure.

Referring to FIG. 14, still another embodiment of a knee pad 50 made in accordance with the present disclosure is shown. Like reference numerals have been used to indicate similar elements. The knee pad 50 shown in FIG. 14 is similar in design and construction to the knee pad illustrated in FIG. 9. The knee pad 50 includes a first pair of straps 60 positioned above a second pair of straps 62. The straps 60 include attachment devices 74 and 75, while the straps 62 are connected to attachment devices 76 and 77. The attachment devices in this embodiment all comprise C-dips. As shown with respect to attachment device 74, the C-clips include an opening 78 and a retaining member 80.

In order to secure the knee pad 50 to a garment, the knee pad 50 can be used in conjunction with a first column of engaging devices 66 on one side opposite a second column of engaging devices 67 on an opposite side of a leg covering. The attachment system may further include a third column of engaging devices 68 opposite a fourth column of engaging devices 69. The first and second columns of engaging devices 66 and 67 are positioned above the third and fourth columns of engaging devices 68 and 69.

In the embodiment illustrated in FIG. 14, the columns of engaging devices are made from a single piece of material and include openings or slots 100 that are configured to receive the attachment devices.

In one embodiment, two adjacent openings 100 may form loops that can be engaged by the C-clip of a corresponding attachment device. For instance, as shown in FIG. 14, each column of engaging devices may include three vertical loops.

Each column of engaging devices or loops is made from a single piece of material. The column, for instance, may be made from a fabric, an elastomeric material, a polymer, or even a metal. In one embodiment, the top column of engaging devices and the bottom column of engaging devices may be made from a single piece of material. For instance, the first column of engaging devices 66 may be on the same strip of material as the third column of engaging devices 68.

In general, any suitable knee pad may be attached or integrated into a pair of pants in any of the embodiments illustrated in FIGS. 1 through 14. In one embodiment, however, a uniquely designed knee pad may be used that is breathable and/or allows air flow in between the knee pad and the wearer. In the past, for instance, many knee pad constructions included no way to either increase air flow between the knee pad and the knee and/or to carry body heat away from the knee pad without compromising the fit or functionality of the knee pad. In accordance with the present disclosure, however, the knee pad can be designed to provide breathability and thus reduce the buildup of body heat.

For instance, as shown in FIG. 14, the knee pad 50 may include an outer shell 200 attached to a cushioning component 202. The outer shell 200 and the cushioning component 202 may be comprised of multiple layers or from a single layer of material. In general, the outer shell 200 is made from a rigid or structural material, such as a plastic or metal. The cushioning component 202, on the other hand, includes at least one compressible layer, such as a layer of foam.

Figure 15:
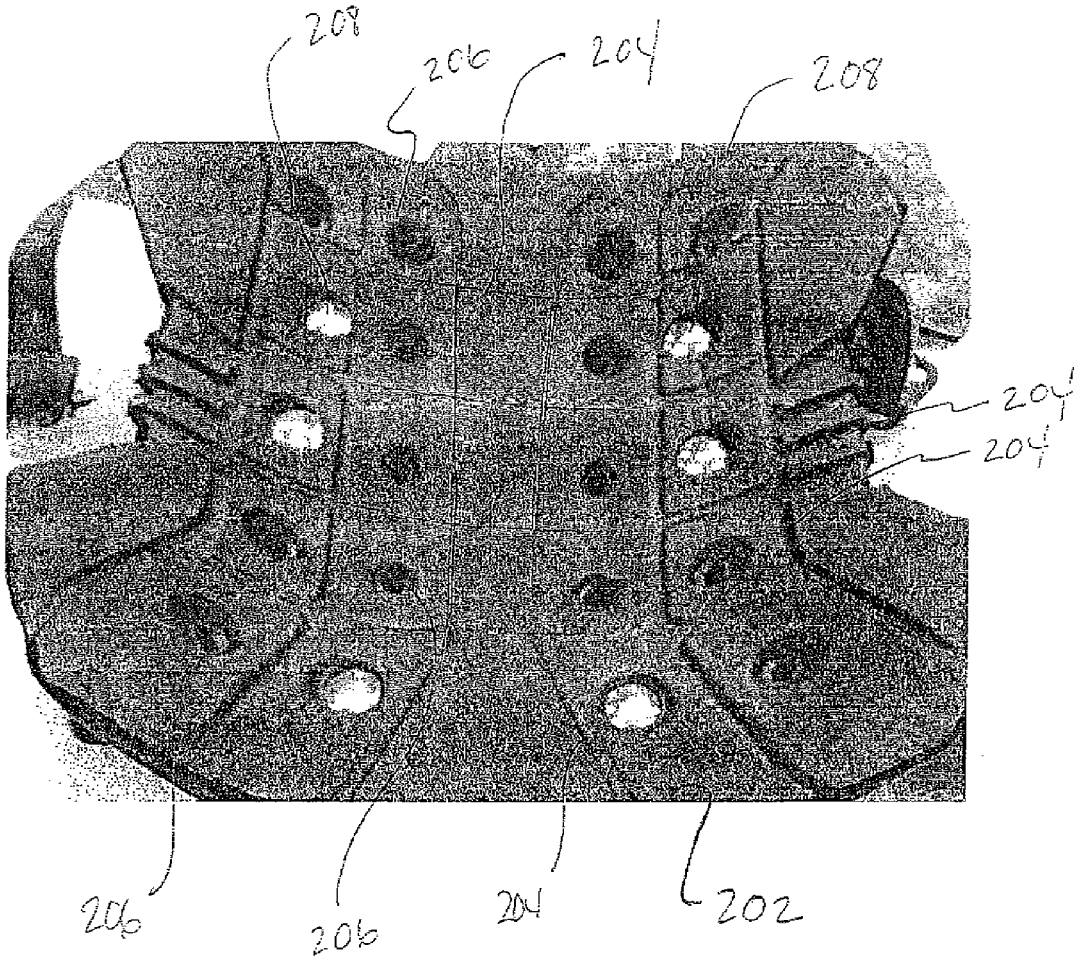
FIG. 15 is a plan view of the wearer side of the knee pad illustrated in FIG. 14.
Figure 16:
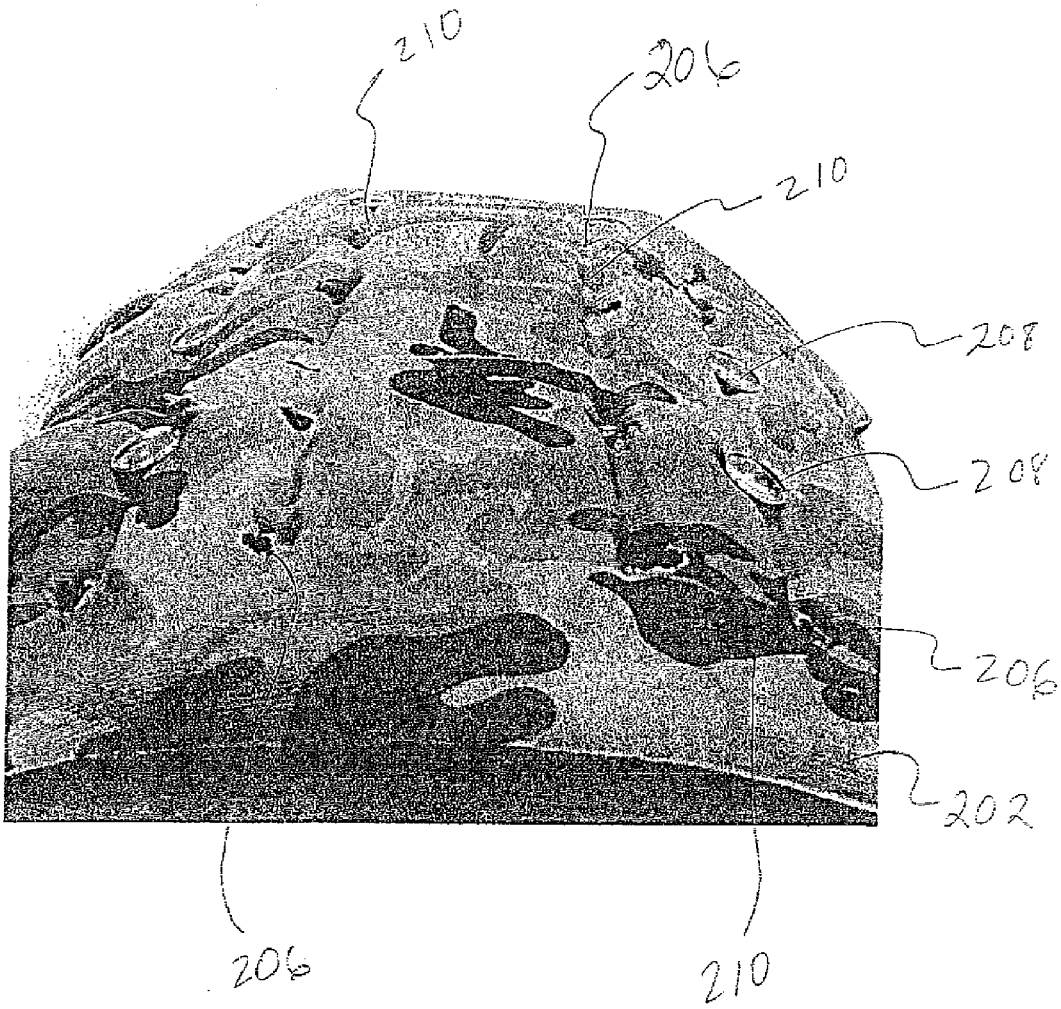
FIG. 16 is a perspective view of the cushioning component present in the knee pad illustrated in FIG. 14.
Figure 17:
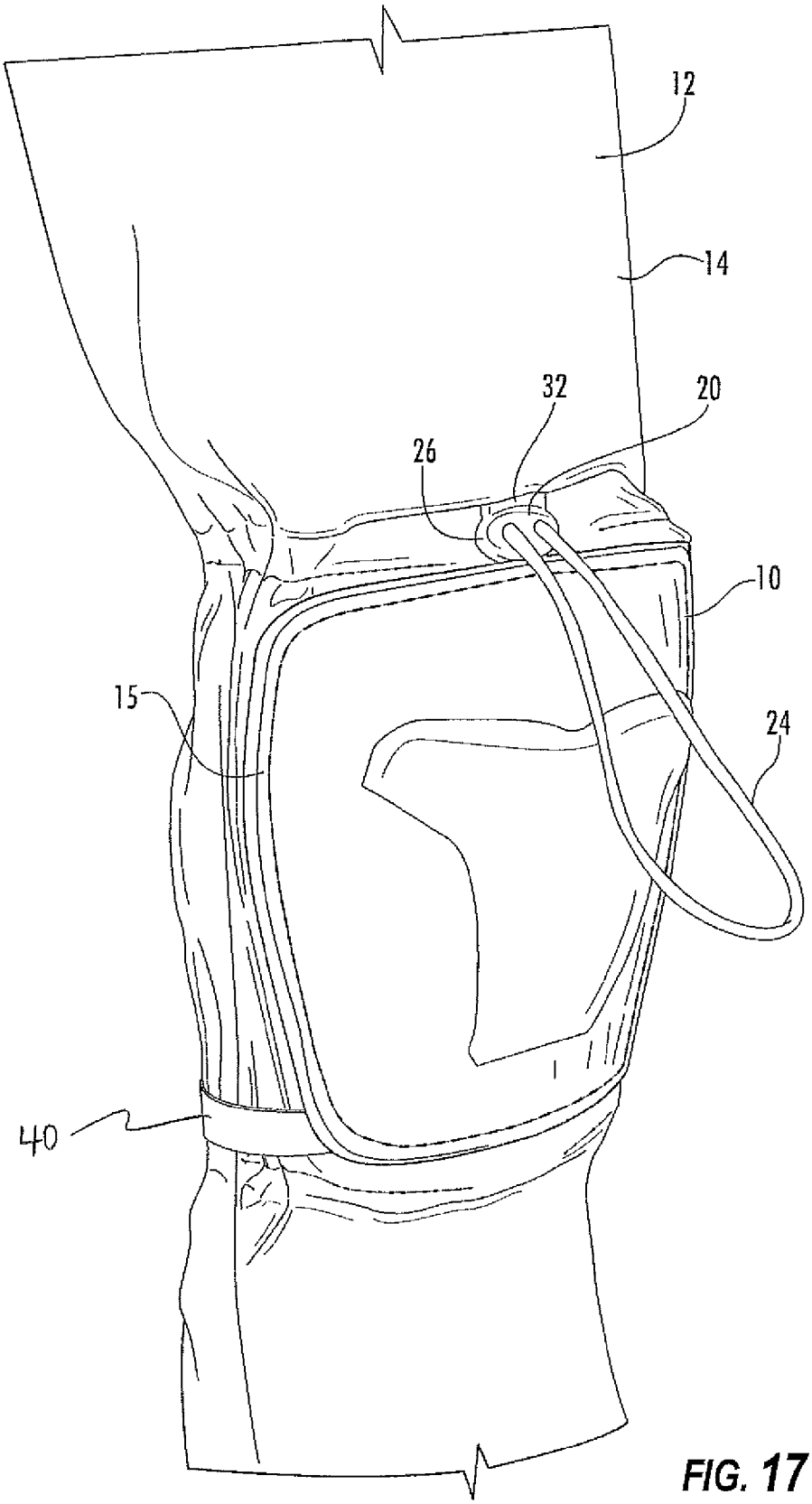
FIG. 17 is a perspective view of still another embodiment of a garment made in accordance with the present disclosure including a knee pad.

Referring to FIGS. 15 and 16, the cushioning component 202 is shown in more detail. In particular, FIG. 15 illustrates a first side of the cushioning component, which is the surface that faces the wearer. FIG. 16, on the other hand, illustrates the opposite side of the cushioning component 202. The side of the cushioning component 202 illustrated in FIG. 16 is placed adjacent to the outer shell 200.

As shown in FIG. 15, the inside surface of the cushioning component 202 may include a plurality of venting channels 204. The venting channels 204 generally extend from an interior of the knee pad to an outer edge of the knee pad. In the embodiment illustrated, for instance, the venting channels 204 form a pattern that extends generally in the lengthwise direction of the article and in the widthwise direction of the article. For instance, some of the venting channels extend the entire length of the knee pad, while other venting channels extend the entire width of the knee pad. As shown, the venting channels can generally follow the contours of the knee pad. In this regard, some of the venting channels have a curvature or flair as they approach the edge of the knee pad.

The number and depth of venting channels 204 can vary depending upon the particular application. In general, for instance, the knee pad may include from one to over 100 venting channels, such as from about one to about 20 venting channels. The venting channels can all have the same width and depth or can vary depending upon location. In the embodiment illustrated, for instance, the product includes various shorter but wider venting channels located along the sides of the product.

The venting channels 204 generally allow heat to escape while also allowing air flow from the outside environment to circulate between the wearer and the knee pad.

In addition to the venting channels 204, the knee pad 50 may also include a plurality of venting passageways 206. The venting channels 204 generally allow air flow in the x-y direction. The venting passageways 206, however, allow air flow in the z-direction.

As shown in FIGS. 15 and 16, the venting passageways 206 extend through the cushioning component 202 and terminate in between the outer shell 200 and the outside surface of the cushioning component. Further, as shown particularly in FIG. 16, the second surface of the cushioning component 202 may include a plurality of venting channels 210 that intersect with the venting passageways 206. The venting channels 210 are designed to allow air flow in between the outer shell 200 and the cushioning component 202. Further, the venting channels 210 intersect with the venting passageways 206 to provide air flow from the venting channels 210 to the interior surface of the knee pad as shown in FIG. 15. Thus, even with the outer shell covering the cushioning component 202, air flow can still occur from the inside surface of the knee pad to the surrounding environment.

In addition to the venting passageways 206, the knee pad may also include venting passageways 208 which extend completely through the entire product. As shown in FIGS. 14, 15 and 16, for instance, the venting passageways 208 extend from the interior surface of the knee pad to the exterior surface of the outer shell. The venting passageways 208 provide a direct pathway from the Interior of the product to the exterior of the product.

The number of venting passageways 206 and 208 present on the product can vary depending upon the particular application. In general, the product can Include from one to about 30 venting passageways, such as from about five to about 20 venting passageways. The number of passageways, however, can vary dramatically depending upon the particular design.

The number of passageways that terminate at the outer cover 200 versus the number of passageways that extend through the entire product can also vary. The passageways 206 that terminate behind the outer cover 200 are generally protected from the environment by the outer shell. Thus, dirt and other contaminants are prevented from entering the passageways. Having passageways that extend through the entire product, however, may provide better ventilation. Thus, one or more venting passageways that extend through the entire product may be desired depending upon the particular application.

These and other modifications and variations to the present Invention may be practiced by those of ordinary skill in the art, without departing from the spirit and scope of the present Invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the Invention so further described in such appended claims.

What is claimed:

1. A garment comprising:

two leg coverings, each leg covering being comprised of a material having a substantially tubular shape configured to accommodate the leg of a wearer and defining a circumference, each leg covering including a front, a back, and two opposing sides, each leg covering including a first vertical column of engaging devices spaced from a second vertical column of engaging devices, each of the entire first and second vertical columns positioned less than 180 degrees from one another along the circumference, the first and second vertical columns positioned on the back of the leg covering and forming corresponding pairs of engaging devices positioned at different heights along the leg covering; and a pair of knee pads, each knee pad for placement over the front of a corresponding leg covering, each knee pad including at least one pair of opposing attachment devices that are configured to releasably attach to a corresponding pair of engaging devices on the leg coverings, the pair of attachment devices on each knee pad for attaching to a pair of engaging devices on one of the leg coverings at a desired vertical height for positioning each knee pad over a knee of a wearer, the attachment devices having an adjustable length such that the attachment devices are configured to releasably gather the material of the leg coverings such that a load put on the attachment devices is distributed along the back portion of the leg coverings.

2. A garment as defined in claim 1, wherein the first vertical column of engaging devices of each leg covering is positioned on one side of the back of the leg covering and the second vertical column of engaging devices is positioned on the opposing side of the back of the corresponding leg covering.

3. A garment as defined in claim 1, wherein the engaging devices comprise loops, slots or ladders.

4. A garment as defined in claim 3, wherein the engaging devices comprise loops or slots and the attachment devices on the knee pads comprise retaining elements that releasably engage the loops or slots.

5. A garment as defined in claim 1, wherein the knee pads include a top and a bottom and wherein the pair of opposing attachment devices are located adjacent the top of each knee pad.

6. A garment as defined in claim 1, wherein the knee pads include a top and a bottom and wherein the pair of opposing attachment devices are located adjacent the bottom of each knee pad.

7. A garment as defined in claim 1, wherein each leg covering further includes a third vertical column of engaging devices spaced from a fourth vertical column of engaging devices, the first and second vertical columns of engaging devices being located above the third and fourth column of engaging devices along each leg covering, each knee pad including a second pair of opposing attachment devices positioned below the first pair of opposing attachment devices, the second pair of opposing attachment devices on each knee pad for attaching to a pair of corresponding engaging devices on the third and fourth vertical columns on one of the leg coverings.

8. A garment as defined in claim 4, wherein the retaining elements comprise C-clips.

9. A garment as defined in claim 1, wherein the two opposing sides of each leg covering are configured as a seam extending along the respective side of the leg covering where the front meets the back.

10. A garment as defined in claim 1, wherein neither knee pad includes any straps that extend around the back of each leg covering.

11. A garment as defined in claim 7, wherein the first vertical column of engaging devices and the third vertical column of engaging devices are located on one side of a corresponding leg covering, while the second vertical column of engaging devices and the fourth vertical column of engaging devices are located on the opposing side.

12. A garment as defined in claim 1, wherein each knee pad comprises:

an outer shell; and a cushioning component attached to the outer shell, the cushioning component including at least one compressible layer and having a first side that faces a wearer and a second side that faces the outer shell, the first side defining at least one venting channel that extends to an outer edge of the first side, the cushioning component further including at least one venting passage that extends from the first side to the second side.

13. A garment as defined in claim 1, wherein the knee pads define a plurality of venting channels.

14. A garment as defined in claim 12, wherein at least some of the venting channels extend from one edge of the cushioning component to an opposite edge of the cushioning component.

15. A garment as defined in claim 13, wherein at least one of the venting channels extends over an entire length of each knee pad and at least one of the venting channels extends over an entire width of each knee pad.

16. A garment as defined in claim 12, wherein the cushioning component defines a plurality of venting passageways.

17. A garment as defined in claim 16, wherein at least one of the venting passageways also extends through the outer shell.

18. A garment as defined in claim 16, wherein at least one of the venting passageways also extends through the outer shell and at least one of the passageways terminates between the second side of the cushioning component and the outer shell.

19. A garment as defined in claim 16, wherein the cushioning component defines more than four venting passageways.

20. A garment as defined in claim 16, wherein the cushioning component defines from about 10 to about 20 venting passageways.

21. A garment as defined in claim 12, wherein the second side of the cushioning component defines at least one venting channel that extends from the venting passageway to an edge of the cushioning component.

22. A garment as defined in claim 14, wherein the cushioning component defines a plurality of venting passageways and wherein a first portion of the venting passageways also extends through the outer shell while a second portion of the outer passageways terminates in between the second side of the cushioning component and the outer shell, and wherein the second side of the cushioning component defines at least one venting channel that extends from each of the second portion of venting passageways to at least one edge of the cushioning component.

* * * * *